US011239537B2

(12) United States Patent
Rhodes et al.

(10) Patent No.: US 11,239,537 B2
(45) Date of Patent: Feb. 1, 2022

(54) MICROWAVE RESONATOR, A MICROWAVE FILTER AND A MICROWAVE MULTIPLEXER

(71) Applicant: ISOTEK MICROWAVE LIMITED, Leeds (GB)

(72) Inventors: John David Rhodes, Menston (GB); David Ibbetson, Oxenhope (GB); Vanessa Walker, Leeds (GB); Christopher Ian Mobbs, Harrogate (GB)

(73) Assignee: ISOTEK MICROWAVE LIMITED, Yorkshire (GB)

( * ) Notice: Subject to any disclaimer, the term of this patent is extended or adjusted under 35 U.S.C. 154(b) by 0 days.

(21) Appl. No.: 16/485,667

(22) PCT Filed: Feb. 13, 2018

(86) PCT No.: PCT/GB2018/050390
§ 371 (c)(1),
(2) Date: Aug. 13, 2019

(87) PCT Pub. No.: WO2018/150171
PCT Pub. Date: Aug. 23, 2018

(65) Prior Publication Data

US 2019/0386365 A1 Dec. 19, 2019

(30) Foreign Application Priority Data

Feb. 15, 2017 (GB) ..... 1702449
Sep. 20, 2017 (GB) ..... 1715171

(51) Int. Cl.
*H01P 1/208* (2006.01)
*H01P 5/02* (2006.01)
(Continued)

(52) U.S. Cl.
CPC ..... *H01P 1/2086* (2013.01); *H01P 5/02* (2013.01); *H01P 7/06* (2013.01); *H01P 7/105* (2013.01)

(58) Field of Classification Search
CPC ..... H01P 1/2086; H01P 1/2084; H01P 5/02; H01P 7/06; H01P 7/10; H01P 7/105
(Continued)

(56) References Cited

U.S. PATENT DOCUMENTS 5,880,650 A 3/1999 Latouche et al.
6,211,752 B1 * 4/2001 Gendraud ..... H01P 7/06 333/208
(Continued)

FOREIGN PATENT DOCUMENTS

CN 1276922 A 12/2000
CN 104485497 A 4/2015
(Continued)

OTHER PUBLICATIONS

UK Intellectual Property Office Search Report issued in UK Application No. GB1702449.8 dated Jul. 27, 2017.
(Continued)

*Primary Examiner* — Robert J Pascal
*Assistant Examiner* — Kimberly E Glenn
(74) *Attorney, Agent, or Firm* — Quinn IP Law

(57) ABSTRACT

A microwave resonator comprising a hollow tube comprising fan electrically conductive tube wall which defines a tube bore, the tube extending along a length axis from a first end to a second end; a first electrically conductive closing plate closing the first end of the tube; a second electrically conductive closing plate closing the second end of the tube; a plurality of dielectric resonant pucks, each puck comprising first and second end faces and a side wall extending therebetween, each puck being dimensioned such that its
(Continued)

dominant mode is a doubly degenerate mode; the pucks being arranged within the tube bore spaced apart from each other and the closing plates, each puck being arranged with its end faces normal to the length axis and centered on the length axis and its side wall abutting the tube wall such that there is no air gap between the puck and tube wall which extends from one end face to the other of the puck, the puck adjacent to the first closing plate being termed the input puck; each puck being separated from the adjacent puck in the tube bore by a coupling gap, each coupling gap having ah electrically conductive iris plate arranged therein, each iris plate being arranged normal to the length axis, each iris plate comprising at least one coupling slot extending therethrough; an input microwave coupler adapted to receive a microwave signal and provide it to the input puck; each puck comprising a symmetry breaking structure for modifying the frequency of one of the degenerate modes relative to the other and the coupling between the two modes.

36 Claims, 23 Drawing Sheets

(51) Int. Cl.
*H01P 7/06* (2006.01)
*H01P 7/10* (2006.01)

(58) Field of Classification Search
USPC ..... 333/136
See application file for complete search history.

(56) References Cited

U.S. PATENT DOCUMENTS

| | | | | |
|---|---|---|---|---|
| 10,224,588 | B2 * | 3/2019 | Weiß | H01P 1/2133 |
| 2010/0013578 | A1 | 1/2010 | Memarian et al. | |
| 2015/0180106 | A1 | 6/2015 | Ezzeddine | |
| 2016/0322688 | A1 | 11/2016 | Weiss | |

FOREIGN PATENT DOCUMENTS

| | | | |
|---|---|---|---|
| CN | 106252797 | A | 11/2016 |
| EP | 0742603 | A1 | 11/1996 |
| ES | 2561384 | T3 | 2/2016 |
| WO | 2013085357 | A1 | 6/2013 |

OTHER PUBLICATIONS

UK Intellectual Property Office Search Report issued in UK Application No. GB1802310.1 dated May 4, 2018.
International Search Report issued in International Application No. PCT/GB2018/050390 dated May 3, 2018.
Luca Pelliccia et al "Ultra-compact pseudoelliptic waveguide filters using TM dual-mode dielectric resonators", Microwave Conference Proceedings (APMC), 2011 Asia-Pacific, IEEE, Dec. 5, 2011, p. 143-146.
Ji-Fuh Liang et al, "High-<maths><tex>$Q$</tex></maths> TEO1 Mode DR Filters for PCS Wireless Base Stations", IEEE Transactions on Microwave Theory and Techniques, Plenum, USA, vol. 46, No. 12, Dec. 1, 1998, p. 2497-2498.
Chinese Office Action for application No. CN 201880011125.0, dated Dec. 1, 2020.
Ji-Fuh Liang et al., "High-Q TEOI Mode DR Filters for PCS Wireless Base Stations", IEEE Transactions On Microwave Theory and Techniques, Dec. 1, 1998, vol. 46, No. 12.
Great Britain Examination Report for GB patent application GB1802310.1, dated Jul. 7, 2021.

* cited by examiner

MICROWAVE RESONATOR, A MICROWAVE FILTER AND A MICROWAVE MULTIPLEXER

The present invention relates to a microwave resonator. More particularly, but not exclusively, the present invention relates to a microwave resonator comprising a hollow tube defined by an electrically conductive tube wall, the tube being closed at both ends by closing plates and a plurality of dielectric spaced apart resonant pucks arranged in the tube, each puck being dimensioned to resonate in a doubly degenerate dominant mode, each puck comprising a symmetry breaking structure for modifying the frequency of one of the degenerate modes relative to the other and the coupling between the two modes. The present invention also relates to a microwave filter comprising a plurality of such microwave resonators. The present invention also relates to a microwave multiplexer comprising a plurality of such resonators.

Microwave resonators are common components in microwave devices such as microwave filters and multiplexers. Such microwave resonators must typically meet a number of requirements. Preferably they are small to minimise the size of the microwave device. They should have a high Q factor and should also generate low passive intermodulation products. Preferably they should be able to operate when receiving a high-power signal. They should also be simple and inexpensive to manufacture.

EP0742603 discloses a multimode resonator for a microwave filter. The resonator comprises a cavity and a dielectric resonator element disposed inside the cavity. Whilst in some embodiments the dielectric resonator element abuts the cavity at a plurality of spaced apart points there is a substantial air gap between the dielectric resonator element and the cavity which extends from one end of the dielectric resonator element to the other. As a result of this the resonator is large.

The present invention seeks to overcome the problems of the prior art.

Accordingly, in a first aspect, the present invention provides a microwave resonator comprising a hollow tube comprising an electrically conductive tube wall which defines a tube bore, the tube extending along a length axis from a first end to a second end;

a first electrically conductive closing plate closing the first end of the tube;

a second electrically conductive closing plate closing the second end of the tube;

a plurality of dielectric resonant pucks, each puck comprising first and second end faces and a side wall extending therebetween, each puck being dimensioned such that its dominant mode is a doubly degenerate mode;

the pucks being arranged within the tube bore spaced apart from each other and the closing plates, each puck being arranged with its end faces normal to the length axis and centered on the length axis and its side wall abutting the tube wall such that there is no air gap between the puck and tube wall which extends from one end face to the other of the puck, the puck adjacent to the first closing plate being termed the input puck;

each puck being separated from the adjacent puck in the tube bore by a coupling gap, each coupling gap having an electrically conductive iris plate arranged therein, each iris plate being arranged normal to the length axis, each iris plate comprising at least one coupling slot extending therethrough;

an input microwave coupler adapted to receive a microwave signal and provide it to the input puck;

each puck comprising a symmetry breaking structure for modifying the frequency of one of the degenerate modes relative to the other and the coupling between the two modes.

The microwave resonator according to the invention is highly compact. It has a high Q and also produces low passive intermodulation products. It can receive a high power microwave signal. It is also simple to manufacture. In particular the lack of an air gap between the pucks and the tube wall changes the resonant behaviour of the pucks enabling a significant reduction in size without loss of performance.

Further, the microwave resonator according to the invention is highly flexible. By simple modification of the symmetry breaking structure to change the relative frequencies and coupling between modes one can significantly alter the behaviour of the resonator.

Preferably the pucks are all of the same thickness from one end face to the other.

Preferably each of the pucks is dimensioned such that the dominant mode is a doubly degenerate $H_{111}$ mode.

Preferably the end faces of each puck are circular.

Preferably the pucks are equally spaced apart.

Preferably the separation between the first closing plate and the input puck is between 0.25 and 0.75 times the thickness of the input puck, more preferably between 0.4 and 0.6 times the thickness of the input puck.

Preferably the sidewall of each puck is coated with an electrically conductive layer, the electrically conductive layer forming a portion of the tube wall.

Preferably a portion of each iris plate forms a portion of the tube wall.

Preferably each iris plate comprises a single coupling slot.

Alternatively, each iris plate comprises two coupling slots, one normal to the other.

Preferably the microwave resonator comprises two pucks only, the two pucks having an iris plate arranged therebetween.

Preferably the face of the input puck adjacent to the first closing plate is termed the input face, the input microwave coupler comprising an electrically conductive coupling strip arranged on the input face.

Preferably the coupling strip is inclined to the at least one coupling slot.

Alternatively, the input microwave coupler comprises (i) an electrically conductive central resonator body extending from the tube wall into the tube bore substantially normal to the length axis;

(ii) an electrically conductive finger extending from the tube wall opposite the central resonator body towards the central resonator body, the central resonator body and finger being arranged in the gap between the input puck and first closing plate; and, (iii) an electrically conductive iris plate arranged in the tube bore normal to the length axis between the central resonator body and input puck.

Alternatively, the input microwave coupler comprises an electrically conductive iris plate arranged in the tube bore substantially normal to the length axis between the input puck and first closing plate, the iris plate having an aperture therein, and a central resonator body extending from the iris plate towards the first closing plate.

Preferably the puck adjacent to the second closing plate is termed the output puck, the microwave resonator further comprising an output microwave coupler adapted to receive a microwave signal from the output puck.

Preferably the face of the output puck adjacent to the second closing face is termed the output face, the output microwave coupler comprising an electrically conductive strip arranged on the output face.

Alternatively, the output microwave coupler comprises (i) an electrically conductive central resonator body extending from the tube wall into the tube bore substantially normal to the length axis;

(ii) an electrically conductive finger extending from the tube wall opposite the central resonator body towards the central resonator body, the central resonator body and finger being arranged in the gap between the output puck and second closing plate; and, (iii) an electrically conductive iris plate arranged in the tube bore normal to the length axis between the central resonator body and output puck.

Alternatively, the output microwave coupler comprises an electrically conductive iris plate arranged in the tube bore substantially normal to the length axis between the output puck and the second closing plate, the iris plate having an aperture therein, and a central resonator body extending from the iris plate towards the second closing plate.

Preferably the symmetry breaking structure of at least one puck comprises a first electrically conductive adjustment strip arranged on a face of the puck, the adjustment strip extending along a first adjustment strip axis passing through the center of the puck.

Preferably the symmetry breaking structure further comprises a second electrically conductive adjustment strip arranged on the same face of the puck as the first, the second electrically conductive adjustment strip extending along a second adjustment strip axis passing through the center of the puck.

Preferably the first and second adjustment strip axes meet at an angle of 25 and 65 degrees, more preferably between 40 and 50 degrees, more preferably between 43 and 47 degrees, more preferably 45 degrees.

Preferably each adjustment strip extends from the tube wall towards the center of the puck face.

Alternatively, each adjustment strip extends from a point proximate to but spaced apart from the tube wall towards the center of the puck face.

Preferably the symmetry breaking structure of at least one puck comprises at least one, preferably a plurality of apertures extending through the puck from one end face to the other parallel to but spaced apart from the length axis.

Preferably for a plurality of pucks, preferably each puck the symmetry breaking structure comprises at least one, preferably a plurality of apertures extending through the puck from one end face to the other parallel to but spaced apart from the length axis.

Preferably for at least one puck the at least one aperture is of a different diameter or different distance from the length axis to the apertures of the remaining pucks.

Preferably for at least one puck the symmetry breaking structure comprises a further aperture extending along the length axis from one face to the other.

Preferably the symmetry breaking structure of at least one puck comprises at least one sot in the puck arranged in a plane normal to the length axis and part way between the first and second end faces of the puck.

Preferably the slot is arranged mid-way between the first and second end faces of the puck.

Preferably a plurality of pucks, preferably each puck, comprise such slots, the dimensions of the at least one slot of at least one puck being different to the dimensions of the slots of the remaining pucks.

Preferably the symmetry breaking structure of at least one puck comprises at least one aperture extending from the side wall of the puck into the puck normal to the length axis.

Preferably the at least one aperture is arranged mid way between the end faces of the puck.

Preferably a plurality of pucks, preferably each puck comprises at least one such aperture, the diameter of the aperture of at least one puck being different to those of the remaining pucks.

In a further aspect, the present invention provides a microwave filter comprising a plurality of microwave resonators as claimed in any one of claims 1 to 34

In a further aspect, the present invention provides a microwave multiplexer comprising a plurality of microwave resonators as claimed in any one of claims 1 to 34

The present invention will now be described by way of example only and not in any limitative sense with reference to the accompanying drawings in which—

Figure 1:
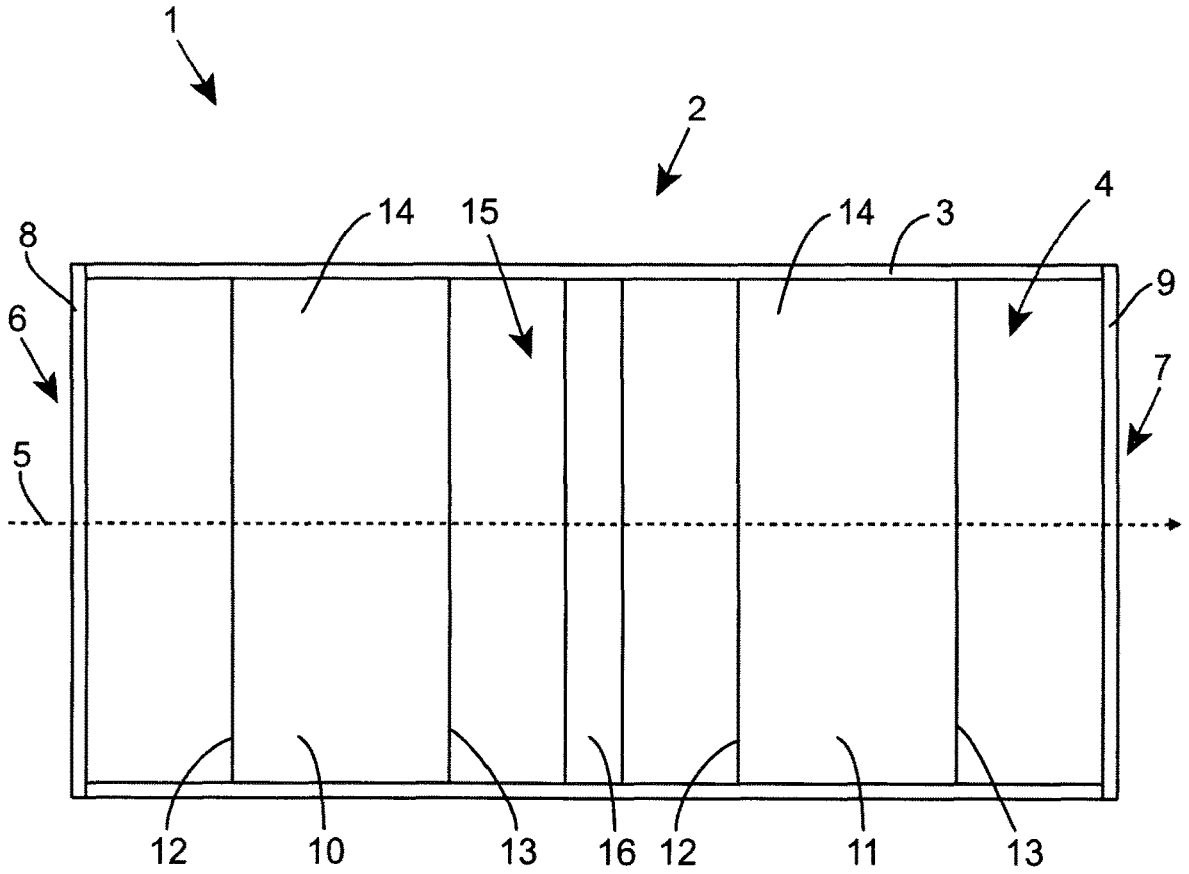
FIG. 1 shows a microwave resonator according to the invention in vertical cross section.
Figure 22:
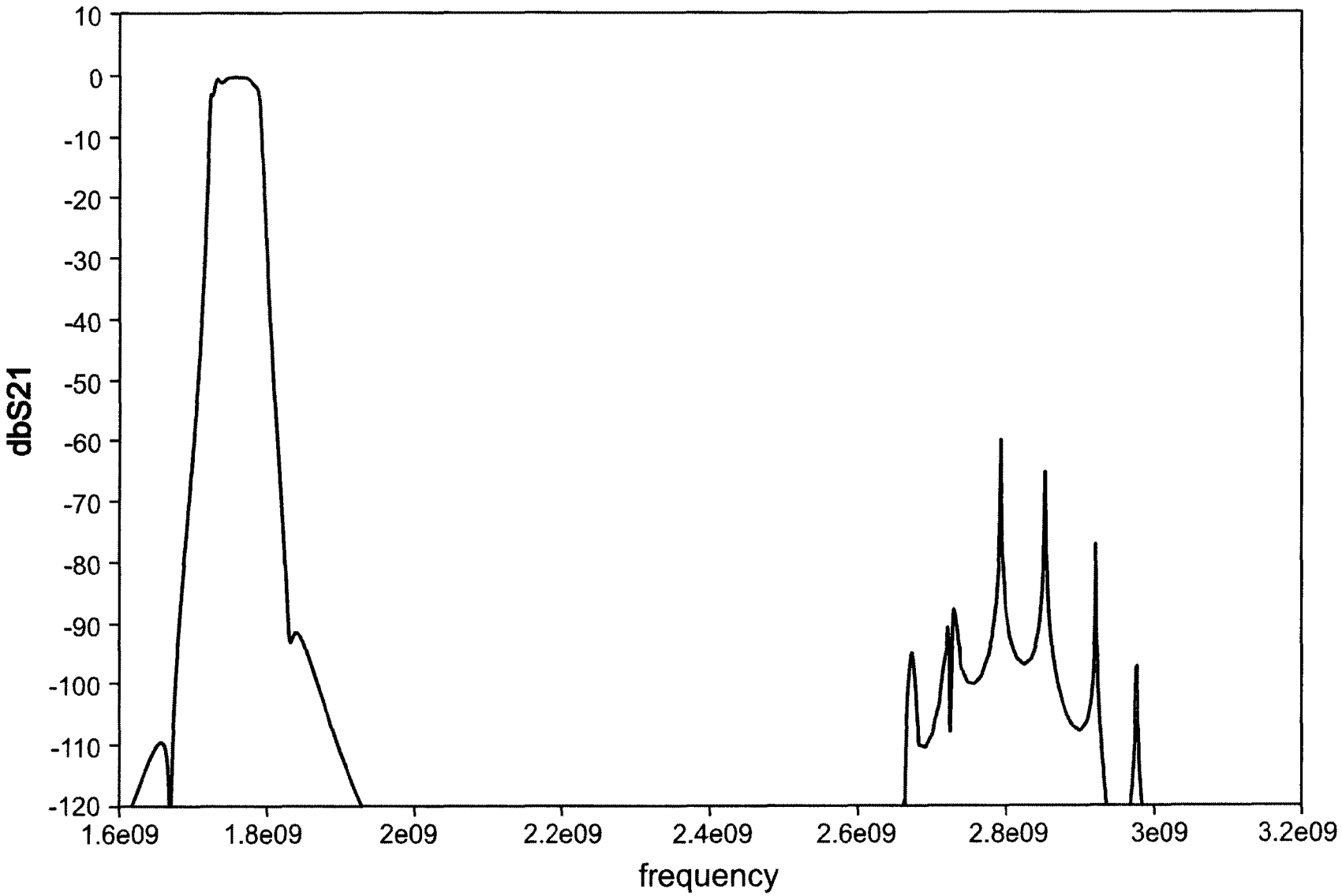
Figure 23:
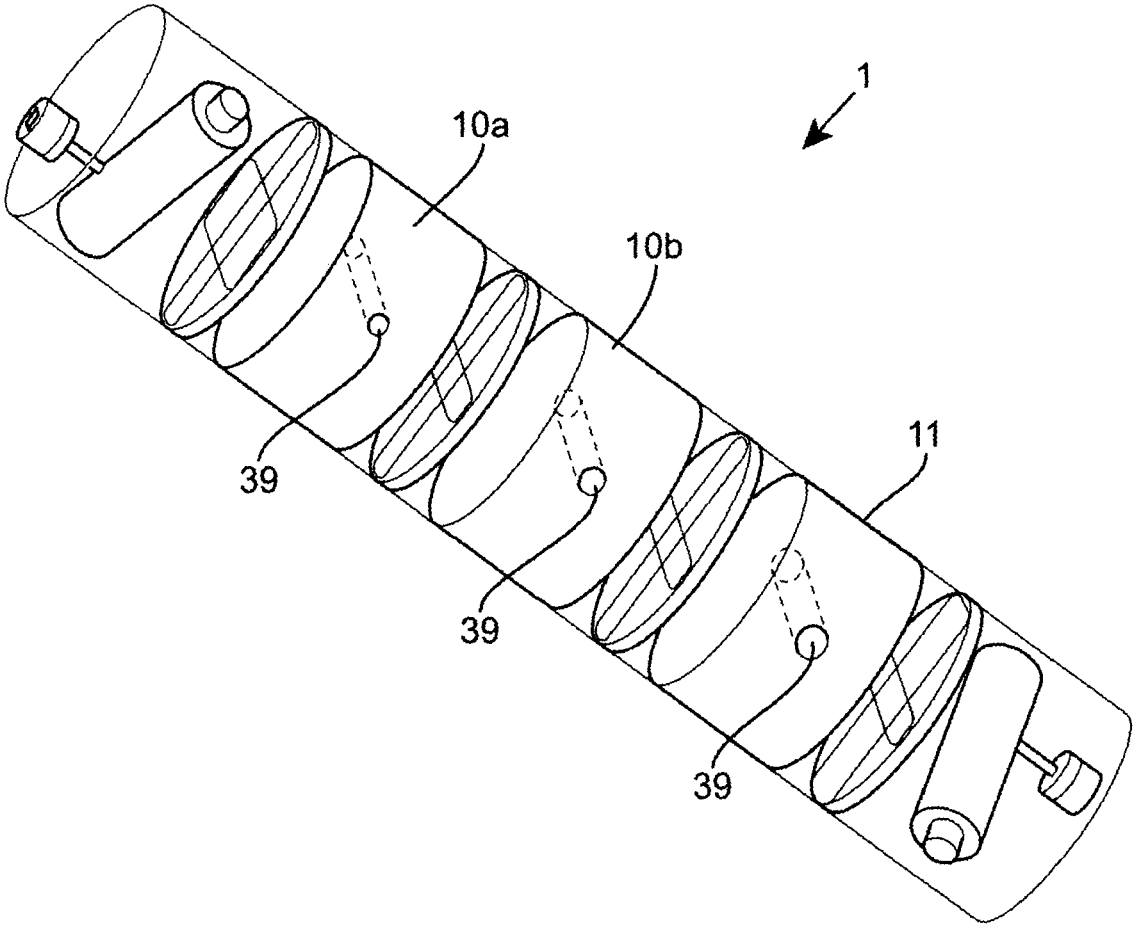

FIG. 22 shows the behaviour of the microwave resonator according to the invention; and FIG. 23 shows a further embodiment of a microwave resonator according to the invention Shown in FIG. 1 in vertical cross section is an embodiment of a microwave resonator 1 according to the invention. The microwave resonator 1 of this embodiment is a quadrupole microwave resonator 1.

The microwave resonator 1 comprises a hollow tube 2. The tube 2 comprises an electrically conductive tube wall 3 which defines a tube bore 4. The tube bore 4 extends along a length axis 5 from a first end 6 of the tube 2 to the second end 7 of the tube 2. The tube bore 4 of this embodiment of the invention is circular normal to the length axis 5.

A first electrically conductive closing plate 8 closes the first end 6 of the tube 2. A second electrically conductive closing plate 9 closes the second end 7 of the tube 2.

Arranged within the tube bore 4 are first and second dielectric resonant pucks 10,11. Each puck 10,11 comprises first and second end faces 12,13 and a side wall 14 extending therebetween. In this embodiment, the end faces 12,13 of each of the pucks 10,11 are circular. The diameter of each of the end faces 12,13 is equal to the diameter of the tube bore 4 such that the side wall 14 abuts the tube bore 4 over the entirety of the side wall 14 such that there is no air gap between the side wall 14 of the puck and the tube wall 3 which extends from one end face 12 of the puck 10,11 to the other end face 13. To put this another way if one were to look along the bore 4 of the tube one could not see past the puck 10,11 through a gap between the puck 10,11 and the tube wall 3. In practice the tube 2 is heated causing it to expand slightly. The pucks 10,11 are then inserted into the tube 2 and the tube 2 is then allowed to cool and contract so gripping the pucks 10,11 and holding them in place.

The puck 10 adjacent to the first closing plate 8 is termed the input puck. The face 12 of the input puck 10 adjacent to the first closing plate 8 is termed the input face. The puck 11 adjacent to the second closing plate 9 is termed the output puck. The face 13 of the output puck 11 adjacent to the second closing plate 9 is termed the output face, Each puck 10 has a thickness measured along the length axis 5 from one end face 12 to the other end face 13. The separation between the first closing plate 8 and the input face 12 of the input puck 10 is typically between 0.25 and 0.75 times the thickness of the input puck 10, more preferably between 0.4 and 0.6 times the thickness of the input puck 10. In this embodiment, the separation between the first closing plate 8 and the input face 12 is 0.5 times the thickness of the input puck 10.

Similarly, the separation between the second closing plate 9 and the output face 13 of the output puck 11 is typically between 0.25 and 0.75 times the thickness of the output puck 11, more preferably between 0.4 and 0.6 times the thickness of the output puck 11. In this embodiment the separation between the second closing plate 9 and the output face 13 of th output puck 11 is 0.5 times the thickness of the output puck 11.

The dielectric of each puck 10,11 typically has a dielectric constant in the range 10 to 80. More typically the dielectric constant has any of the values 10, 20 40 and 80 to within ten percent. Higher dielectric constants are used in resonators operating at lower frequencies.

The two pucks are identical 10,11. Each puck 10,11 is dimensioned such that its dominant mode is a doubly degenerate mode, preferably the $H_{111}$ mode.

The two pucks 10,11 are spaced apart by a coupling gap 15 extending therebetween. Arranged within the coupling gap 15 is an electrically conductive iris plate 16. The iris plate 16 in this embodiment is arranged equally spaced apart from the two pucks 10,11. The iris plate 16 is arranged normal to the length axis 5 as shown. The iris plate 16 is circular and has a diameter equal to that of the tube bore 4 such that the edge of the iris plate 16 abuts the tube bore 4 around the edge of the iris plate 16.

Figure 2:
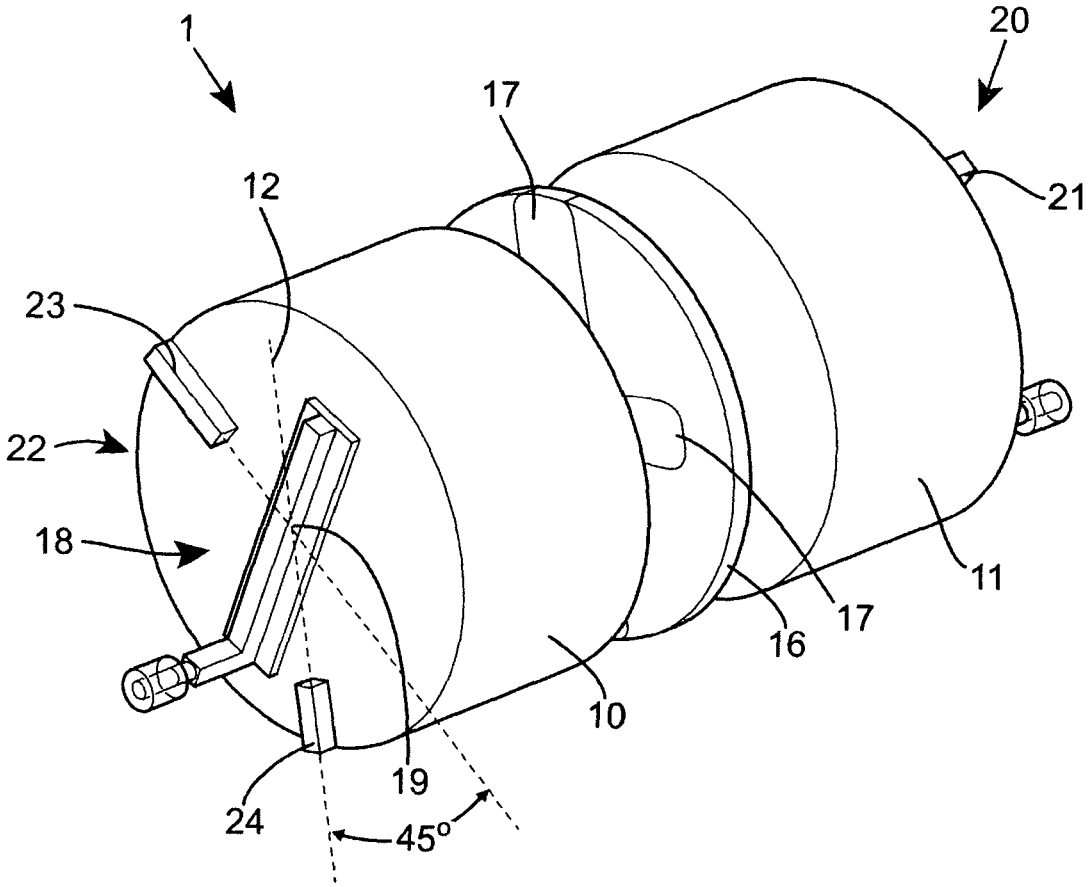
FIG. 2 shows the microwave resonator according to FIG. 1 in perspective view.

Shown in FIG. 2 is the microwave resonator of FIG. 1 in perspective view. For clarity, the tube 2 is not shown.

As can be seen the iris plate 16 comprises two coupling slots 17, one normal to the other. The function of the iris plate 16 and the coupling slots 17 is explained in more detail below.

The microwave resonator 1 further comprises an input microwave coupler 18. The input microwave coupler 18 is adapted to receive an input microwave signal and provide it to the input puck 10. In this embodiment, the input microwave coupler 18 comprises an electrically conductive input coupling strip 19 arranged on the input face 12 of the input puck 10. The input coupling strip 19 is inclined to the coupling slots 17 as shown.

The microwave resonator 1 further comprises an output microwave coupler 20 which receives the microwave signal from the output puck 11. The output microwave coupler 20 comprises an electrically conductive output coupling strip 21 arranged on the output face 13 of the output puck 11. The output coupling strip 21 is inclined to the coupling slots 17.

Each puck 10,11 further comprises a symmetry breaking structure 22. The symmetry breaking structure 22 modifies the frequency of one of the modes relative to the other so that they are no longer degenerate. It also modifies the coupling between the two modes. FIG. 2 shows an example of one such symmetry breaking structure 22 arranged on the input face 12 of the input puck 10. The symmetry breaking structure 22 comprises first and second electrically conductive adjustment strips 23,24 arranged on the input face 12 of the input puck 10. The first and second adjustment strips 23,24 extend along first and second adjustment strip axes respectively. The two axes meet at the center 10 of the puck at an angle of around 45 degrees as shown. More generally this angle is in the range 25 to 65 degrees, more preferably 40 to 50 degrees, more preferably 43 to 47 degrees. In this embodiment, each of the symmetry breaking structures 22 is identical (in the sense that it modifies the relative frequencies of the two modes and the relative coupling between the modes in the same way).

In this embodiment, each adjustment strip 23,24 extends from (and is electrically connected to) the tube wall 3 towards the center of the puck face 12. In alternative embodiments, the adjustment strips 23,24 extend from a point proximate to but spaced apart from the tube wall 3 towards the center of the puck face 12.

Figure 3:
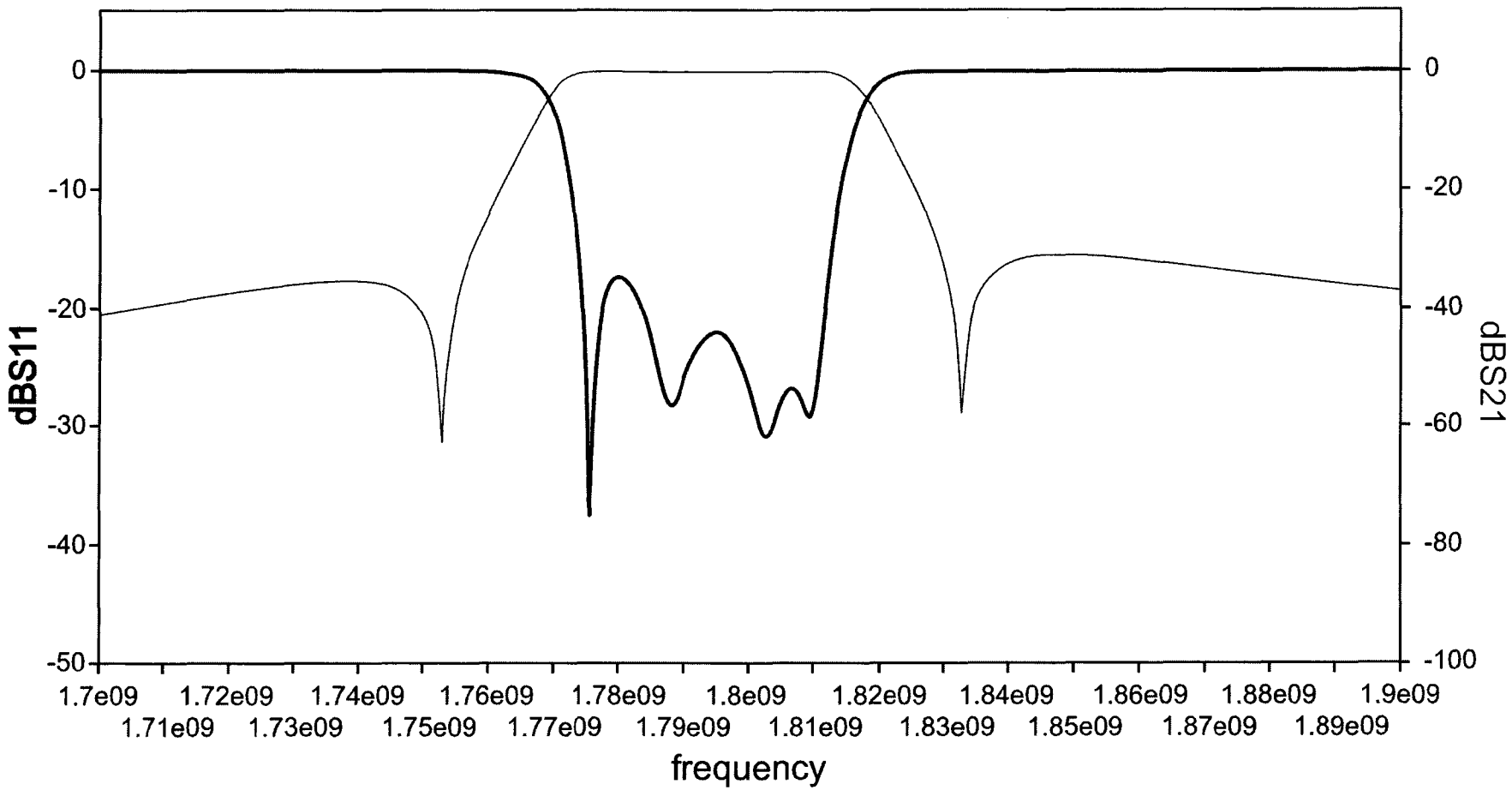
FIG. 3 shows the electrical response of the microwave resonator of FIG. 2.

In use a microwave signal is provided to the input coupling strip 19. This signal couples to the two degenerate modes of the input puck 10. The microwave signal passes through the coupling slots 17 in the iris plate 16 and excites corresponding modes in the output puck 11. The two modes in the output puck 11 couple to the output coupling strip 21 so producing the output signal. The interaction between the two degenerate modes of the input puck 10 and the two degenerate modes of the output puck 11 results in the microwave resonator 1 having two transmissions zeros. FIG. 3 shows the response of the microwave resonator 1 of FIGS. 1 and 2 showing the two transmission zeros.

The operation of the microwave resonator 1 according to the invention can be explained in more detail with reference to the equivalent circuit shown in FIG. 4. Each mode is represented by a node. A first mode in each of the two pucks 10,11 is $M_{11}$. The second mode in each of the two pucks 10,11 is $M_{22}$. $M_{11}$ and $M_{22}$ represent the deviation in frequency for the modes from the central frequency. The coupling between the first mode in one puck 10 and the first mode in the other puck 11 is $M_{14}$. The coupling between the second mode in one puck 10 and the second mode in the other puck 11 is $M_{23}$. The coupling between the two modes in each puck 10,11 is $M_{12}$. The coupling between the input coupling strip 19 and the two modes in the input puck 10 (and also the coupling between the output coupling strip 21 and the two modes in the output puck 11) is $M_{01}$ and $M_{02}$ respectively. There is no coupling between a mode in one puck 10 and a different mode in the other puck 11.

Returning to FIG. 2, it is the distance between the iris plate 16 and the pucks 10,11 that determines the magnitude of the coupling between a mode in one puck 10 and the corresponding mode in the other puck 11. The strength of this coupling however is modified by the areas of the coupling slots 17 in the iris plate 16. The area of one slot 17 relative to the other determines relative strength of the couplings $M_{23}$ and $M_{14}$. A consequence of this is that (to a first approximation) each of the coupling slots 17 can be modified in shape (for example by reducing its length but increasing its width) without changing the behaviour of the microwave resonator 1 provided its area is unchanged. In the extreme, one coupling slot 17 can be reduced in length and increased in width to such an extent that it lies within the other coupling slot 17, so resulting in an iris plate 16 having one coupling slot 17 only.

The action of the symmetry breaking structure 22 is more complex. The position of the first and second adjustment strips 23,24 is set relative to the coupling slots 17 of the iris plate 16. One can rotate the first and second adjustment strips 23,24 on the puck face 12 about the center of the puck 10 without altering the behaviour of the microwave resonator 1 provided one makes an appropriate corrective change to the relative lengths of the first and second adjustment strips 23,24. If one holds the position of the adjustment strips 23,24 constant and changes their relative lengths, or rotates the strips 23,24 and makes a change other than the appropriate change (or no change at all), one changes the coupling between the two modes in the puck 10,11 and also their relative frequencies $M_{11}$ and $M_{22}$. It is possible that in some embodiments of the invention the required length of one of the adjustment strips 23,24 is zero in which case the symmetry breaking structure 22 comprises only one adjustment strip 23,24.

Figure 4:
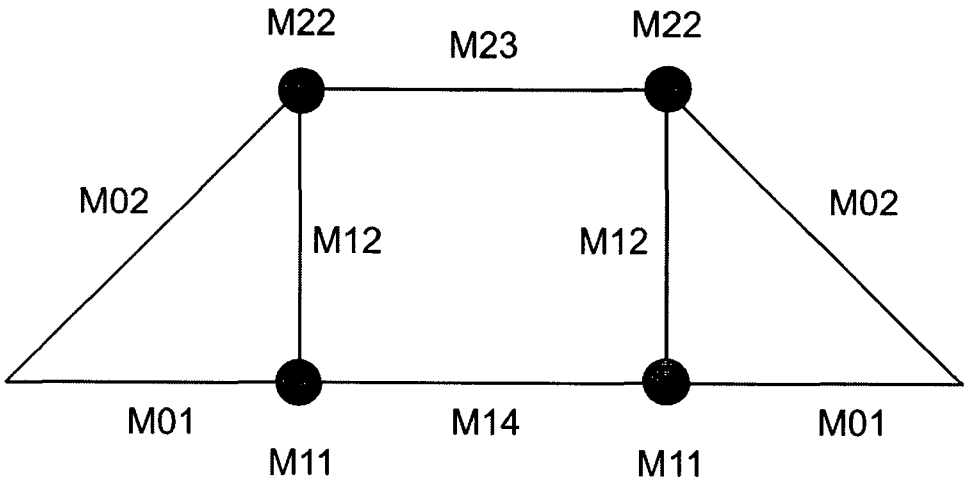
FIG. 4 shows an equivalent circuit for the microwave resonator of FIG. 2.

One can analyse the behaviour of the equivalent circuit of FIG. 4 for a given set of couplings and resonant frequencies. These can then be adjusted to produce a microwave resonator 1 with the desired behaviour. This can then be realised as a microwave resonator 1 with the structure of FIG. 2 with the distance between the pucks 10,11 and the iris plate 16, the sizes of the coupling slots 17 in the iris plate 16 and the positions and sizes of the adjustment strips 23,24 set appropriately.

Figure 5:
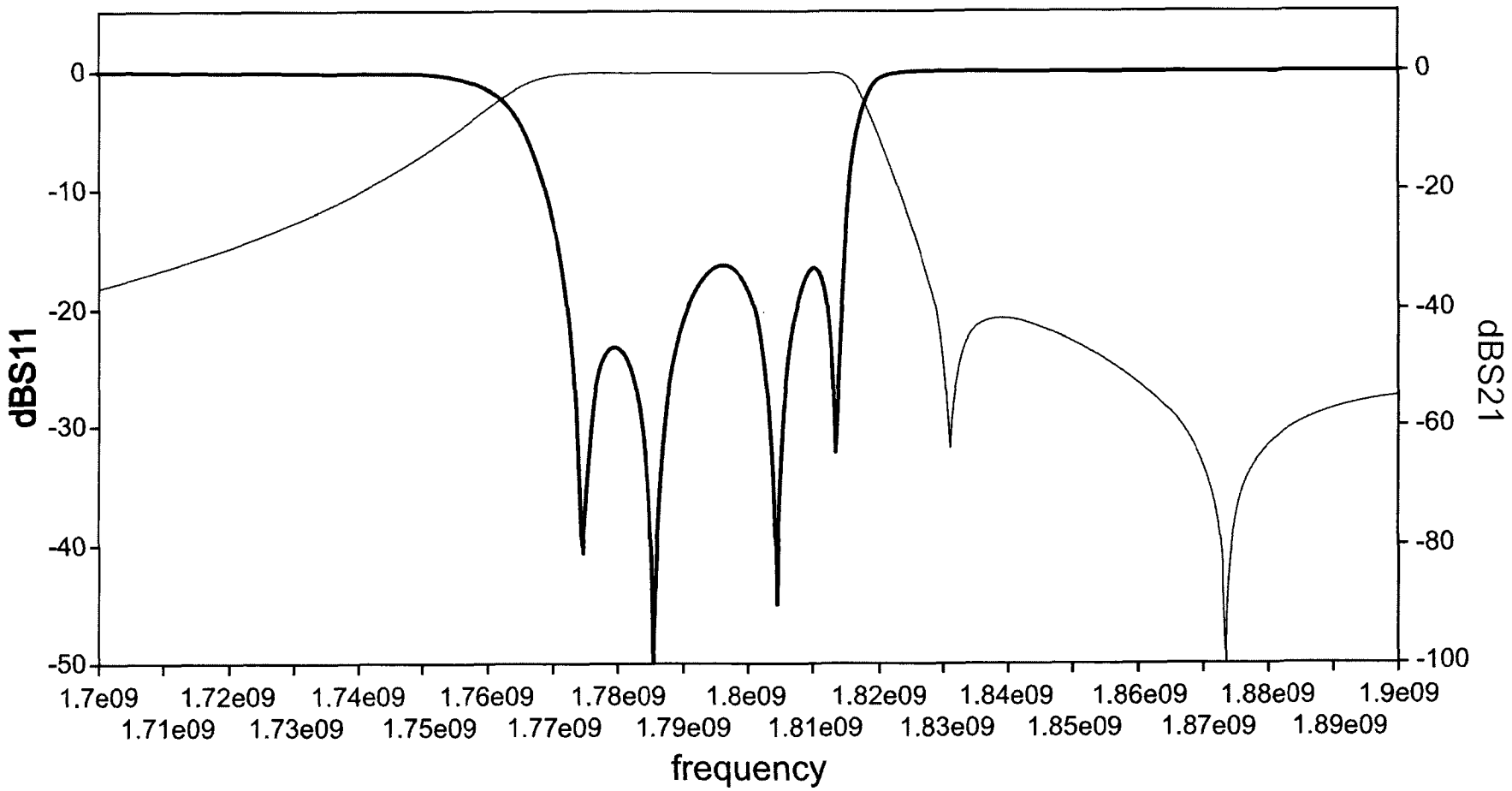
FIG. 5 shows the electrical response of a further embodiment of a microwave resonator according to the invention.

Changes to the design of the microwave resonator 1 can significantly alter its behaviour. Shown in FIG. 5 is the behaviour of an alternative embodiment of a microwave resonator 1 according to the invention. This is similar to the embodiment of FIG. 2 except the relative areas of the coupling slots 17 in the iris plate 16 have been altered so altering the coupling between the modes in one puck 10 and the corresponding modes in the other puck 11. The microwave resonator 1 is now a low pass resonator.

Figure 6:
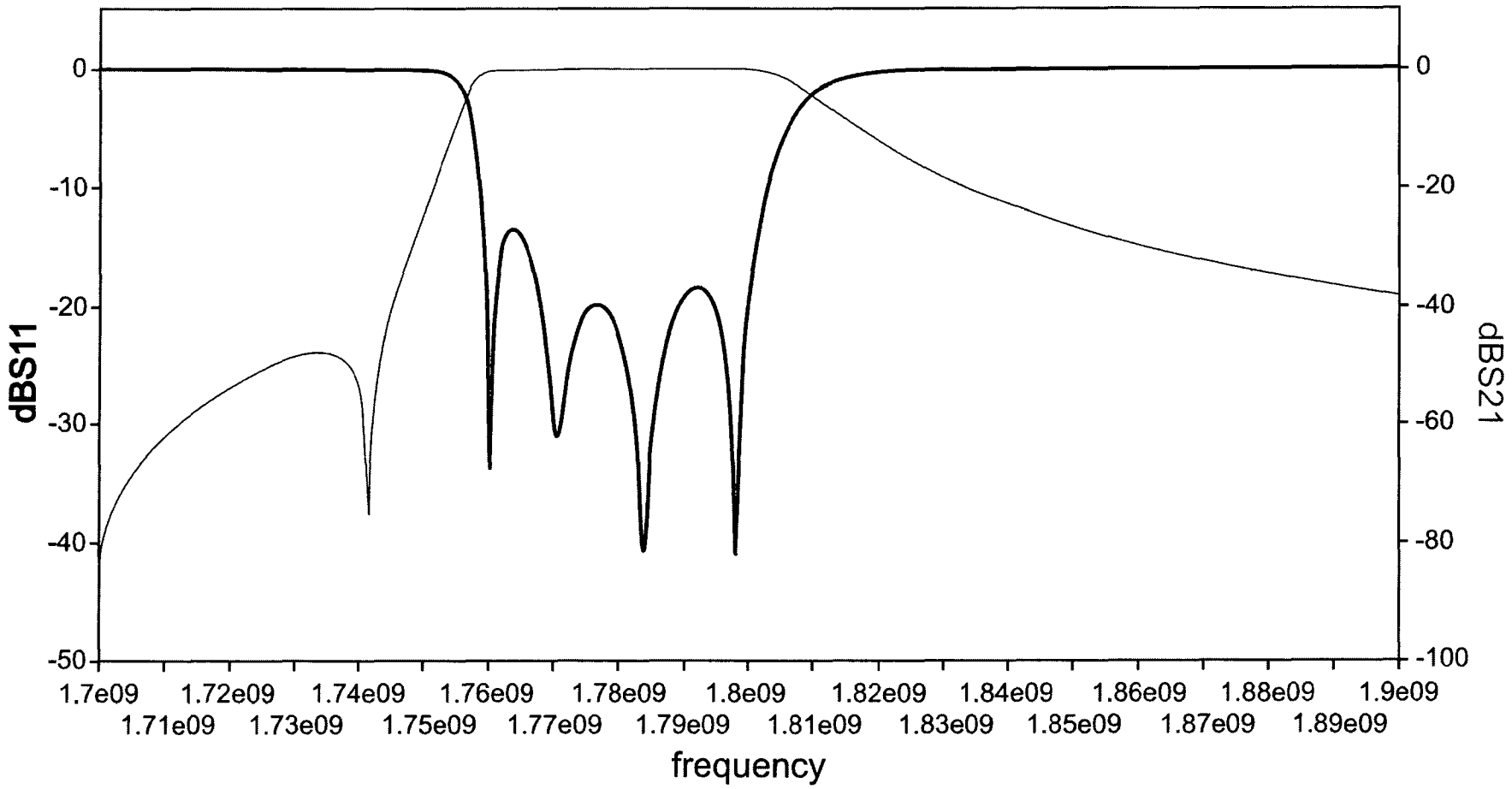
FIG. 6 shows the electrical response of a further embodiment of a microwave resonator according to the invention.
Figure 7:
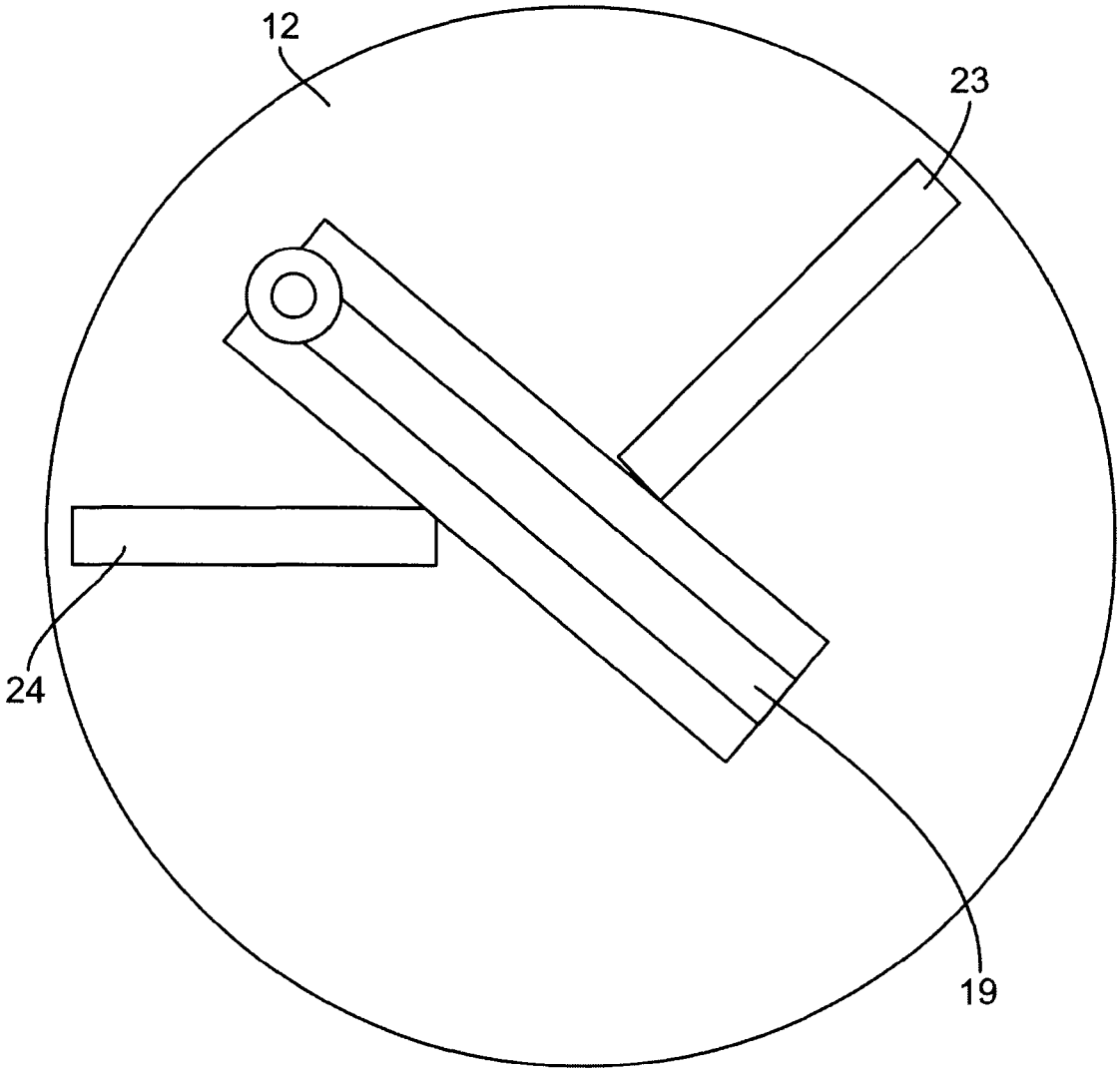
FIG. 7 shows the input face of the input puck of the microwave resonator corresponding to FIG. 6.

Shown in FIG. 6 is the behaviour of a further embodiment of a microwave resonator 1 according to the invention. This embodiment of the microwave resonator 1 is a high pass resonator. Compared to the embodiment of FIG. 2 the dimensions of the first and second adjustment strips 23,24 have been altered so altering the coupling between the modes in the pucks 10,11 and the relative frequencies of the modes. The input face 12 of the input puck 10 of this microwave resonator 1 is shown in FIG. 7 showing the adjustment strips 23,24.

Figure 8:
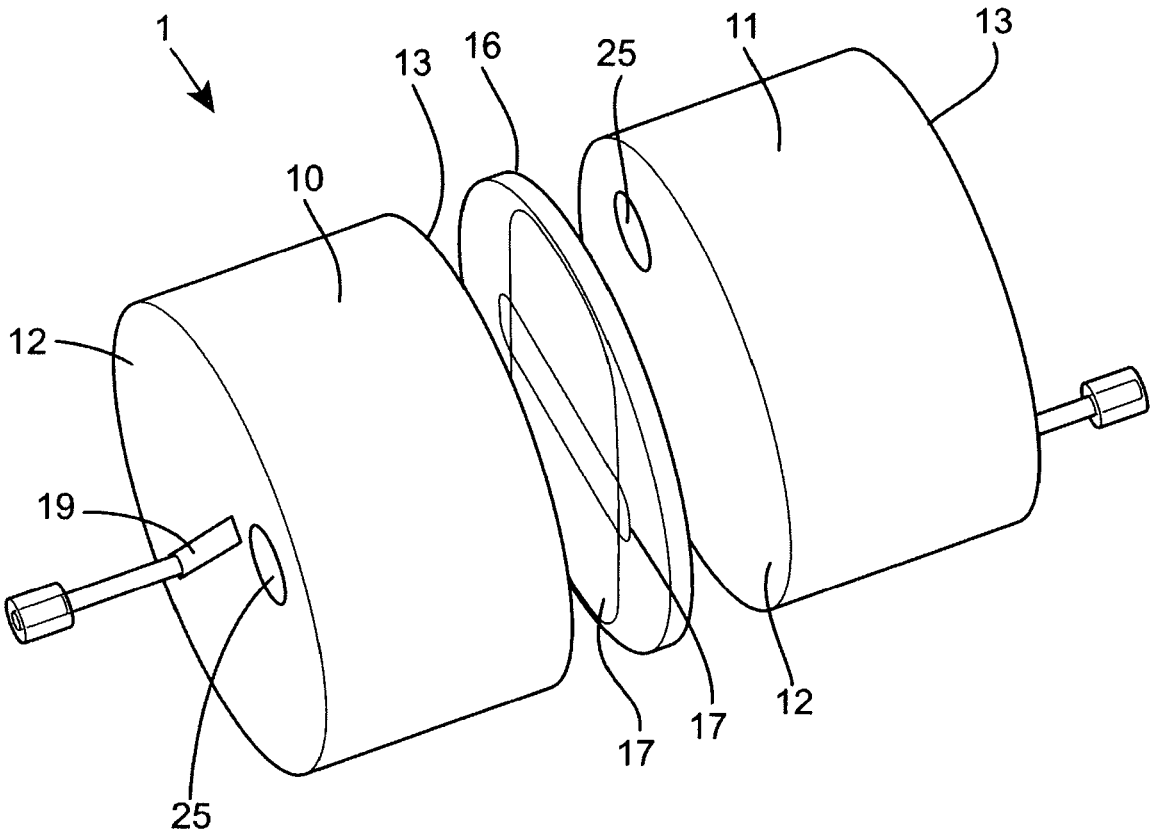
FIG. 8 shows an alternative embodiment of a microwave resonator according to the invention.

Alternative forms of symmetry breaking structure 22 are possible. Shown in FIG. 8 is an alternative embodiment of a microwave resonator 1 according to the invention. In this embodiment, the symmetry breaking structure 22 of each puck 10,11 comprises an aperture 25 extending through the puck 10,11 from one end face 12 to the other end face 13 substantially parallel to the length axis 5. By suitable dimensioning and positioning of the aperture 25 this aperture 25 performs an equivalent function to the symmetry breaking structure 22 described with reference to FIGS. 1 to 7.

Figure 9:
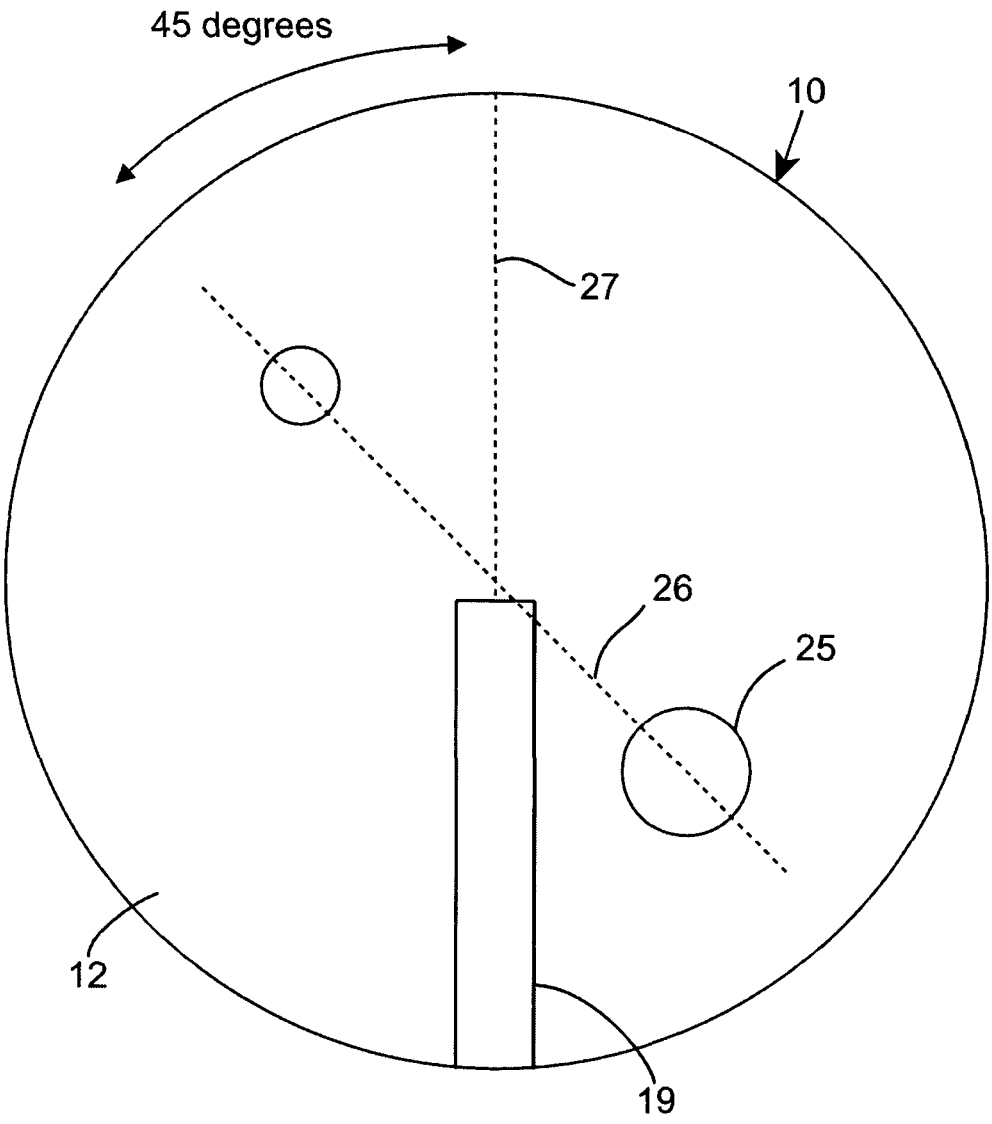
FIG. 9 shows the input face of the input puck of an alternative embodiment of a microwave resonator according to the invention.
Figure 10:
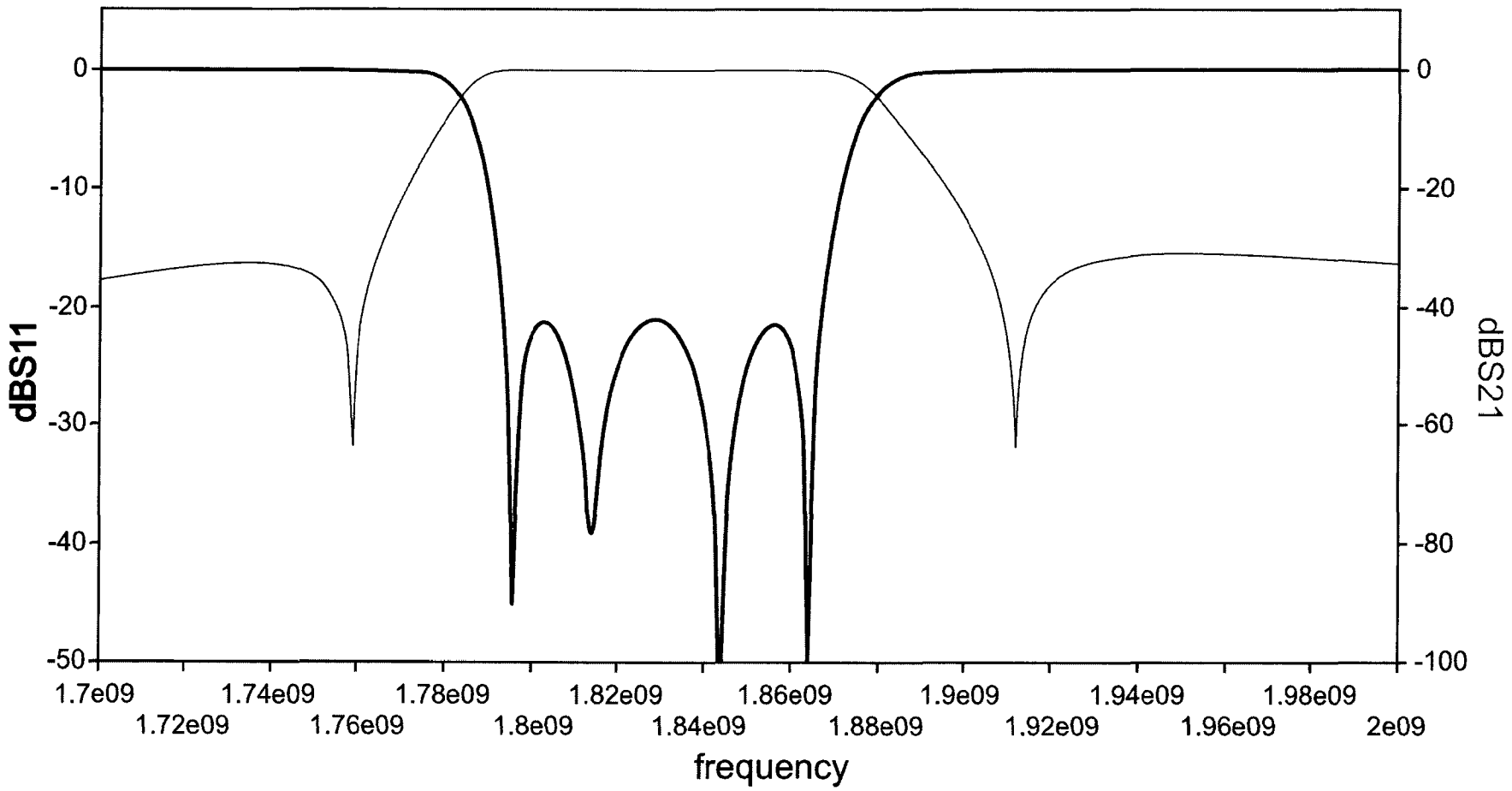
FIG. 10 shows the electrical response of the microwave resonator of FIG. 8.

More typically the symmetry breaking structure 22 comprises two apertures 25. Shown in FIG. 9 is the end face 12 of a puck 10 including two such apertures 25. The apertures 25 are not necessarily of the same size. In this embodiment one aperture 25 has a larger area than the other. A line 26 drawn between the apertures 25 typically passes through the center of the puck face 12. This line 26 meets the axis 27 along which the input coupling strip 19 extends at an angle of around 45 degrees as shown. The behaviour of the embodiment of the microwave resonator 1 of FIG. 8 is shown in FIG. 10.

Figure 11:
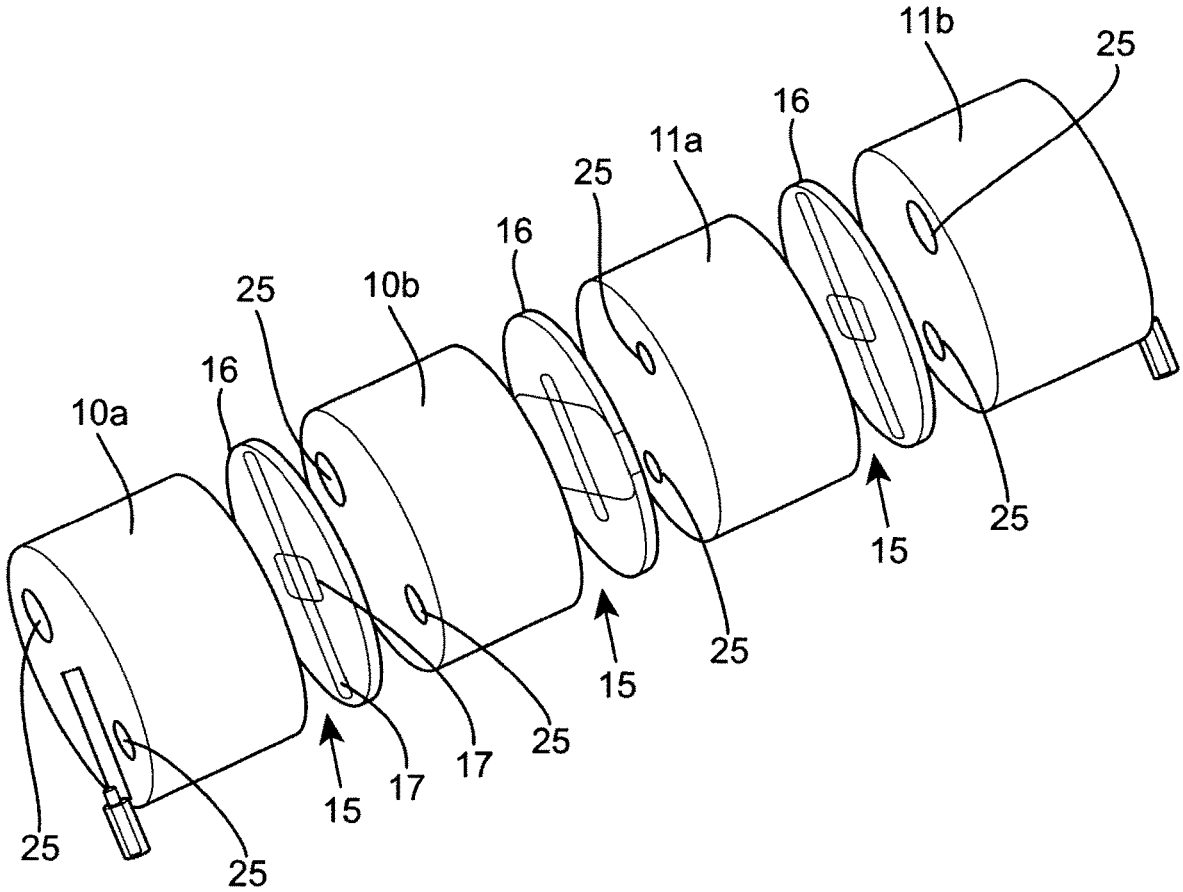
FIG. 11 shows a further embodiment of a microwave resonator according to the invention in perspective view.

Shown in FIG. 11 is a further embodiment of a microwave resonator 1 according to the invention in perspective view. This embodiment is an eight-pole microwave resonator comprising four pucks 10*a*, 10*b*, 11*a*, 11*b*. Arranged in the coupling gaps 15 between each of the pucks 10*a*, 10*b*, 11*a*, 11*b* are iris plates 16, each of which comprises two coupling slots 17. Each puck comprises a symmetry breaking structure 22 comprising two apertures 25 extending through the puck 10*a*, 10*b*, 11*a*, 11*b*.

Figure 12:
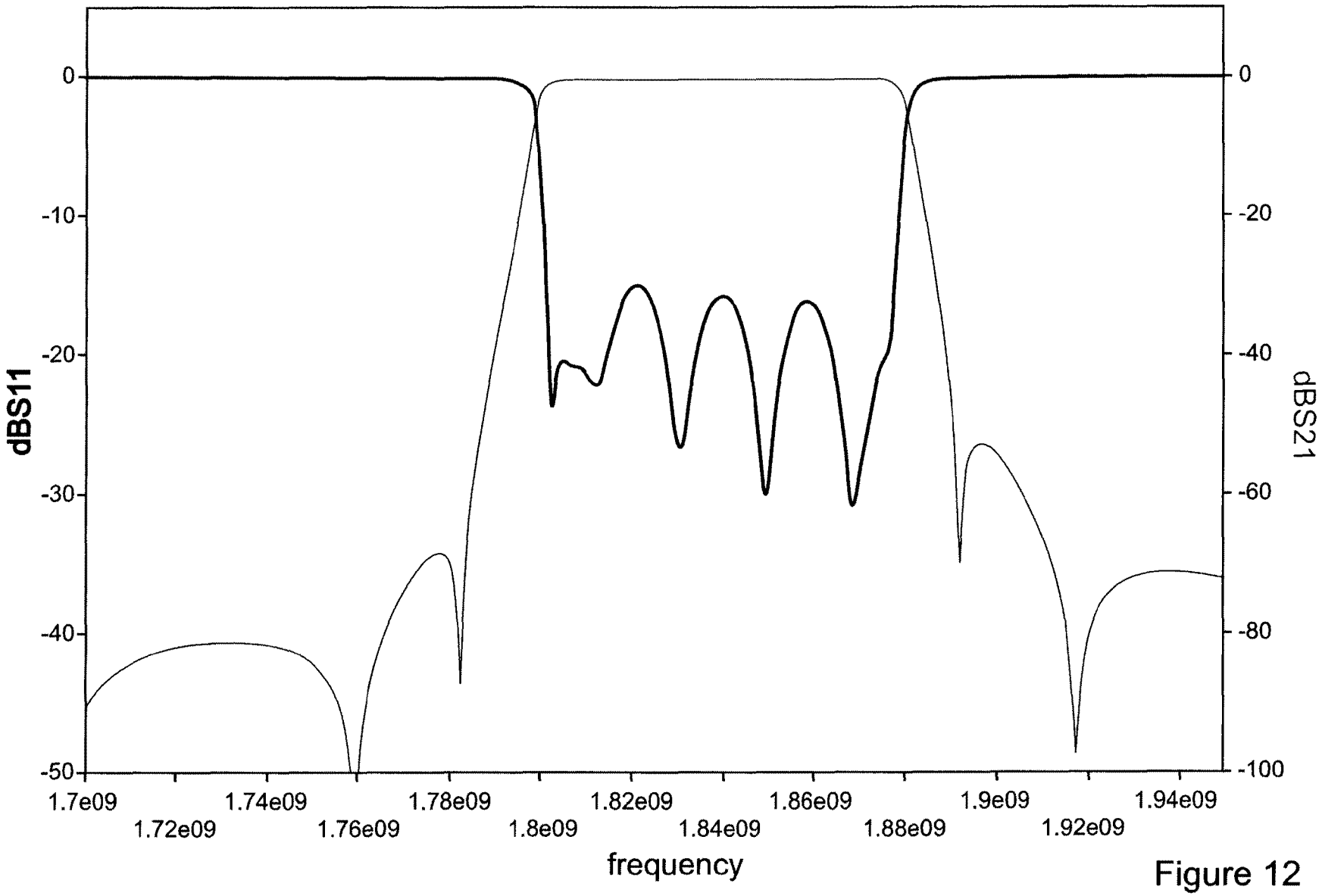
FIG. 12 shows the electrical response of the microwave resonator of FIG. 11.

The operation of such a microwave resonator 1 is very similar to that previously described except there are a larger number of degrees of freedom which can be adjusted in the design stage. A typical behaviour of such a resonator 1 is shown in FIG. 12. The microwave resonator 1 has four transmission zeros.

Figure 13:
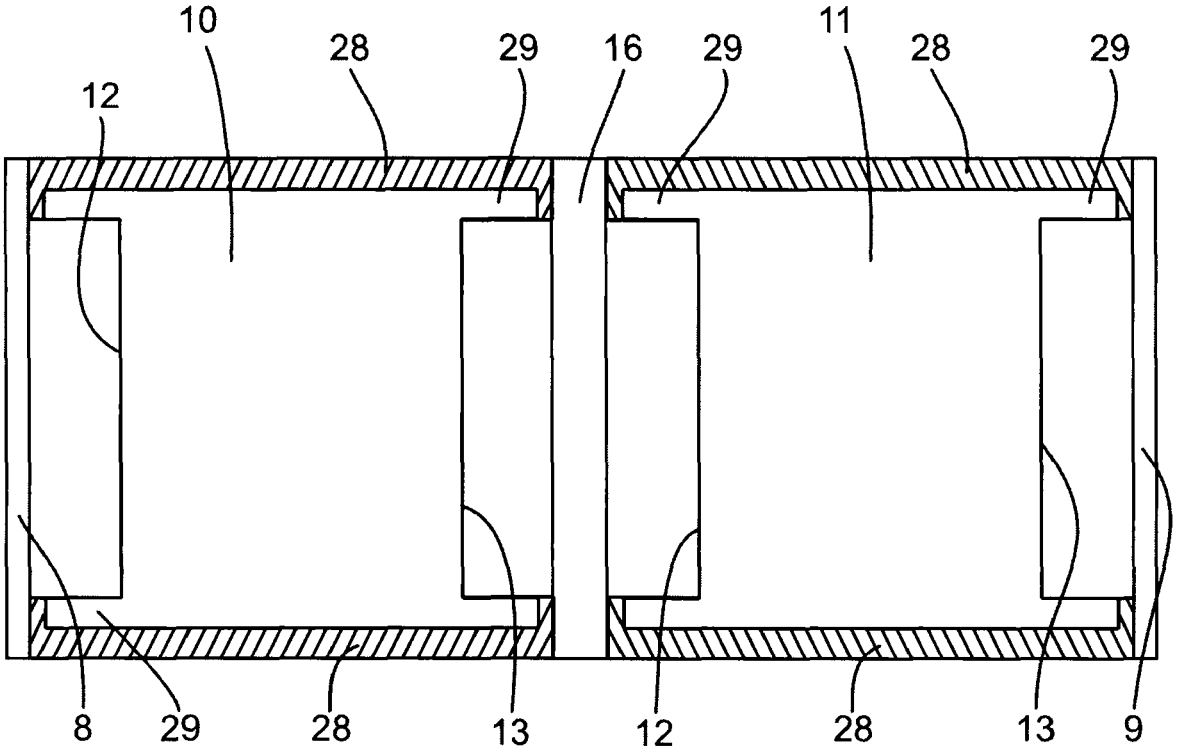
FIG. 13 shows a further embodiment of a microwave resonator according to the invention in vertical cross section.

Shown in FIG. 13 is a further embodiment of a microwave resonator 1 according to the invention in vertical cross section. The microwave resonator 1 comprises first and second pucks 10,11 as before. Each puck 10,11 is coated with a metal film 28 (shown hatched). An end of each puck 10,11 is connected to the iris plate 16 to produce the microwave resonator 1. The metal film 28 and the periphery of the iris plate 16 together form the electrically conductive tube wall 3.

In order to ensure the correct spacing between the end faces 12,13 of the puck 10,11 and both the iris plate 16 and the closing plates 8,9 each puck 10,11 has a collar portion 29 which extends from each end face 12,13 of the puck 10,11 as shown. In practice the puck 10,11 is manufactured as a wide disk and then wide recesses formed in each end to form the collar 29. The puck 10,11 is then coated with the metal film 28.

The manufacture of this embodiment of the microwave resonator 1 is simpler than the manufacture of the embodiment of FIG. 2. One simply needs to connect the ends of each metallised puck 10,11 to the iris plate 16, typically by welding or similar. There is no need to heat a separate metal tube 2 and to insert the ceramic pucks 10,11 into the tube 2.

In all of the above embodiments the input microwave coupler 18 comprises an electrically conductive coupling strip 19 arranged on the input face 12 of the input puck 10. In practice this can be difficult to achieve. If the coupling strip 19 is not connected to the input face 12 along its full length this can affect the behaviour of the microwave resonator 1.

Figure 14:
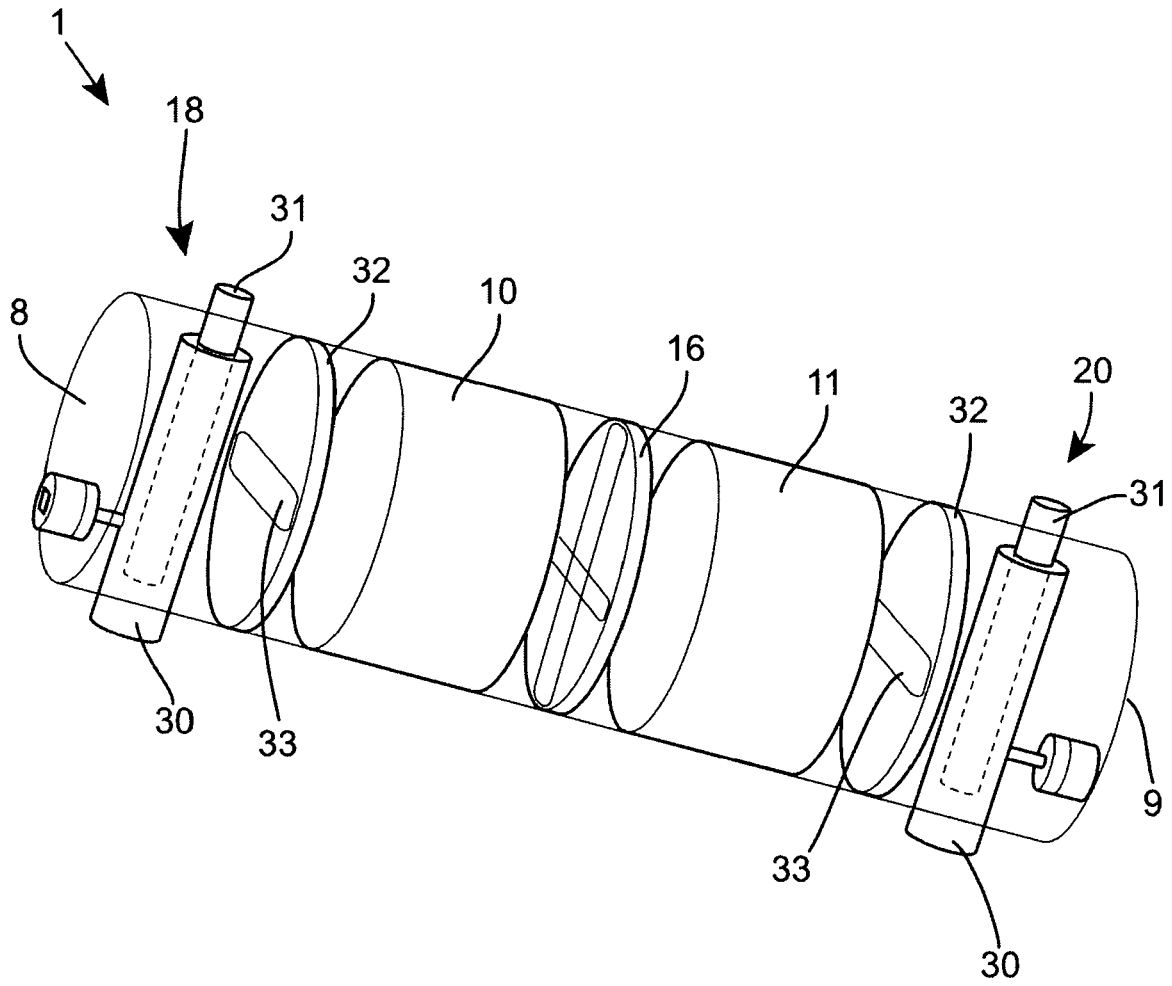
FIG. 14 shows a further embodiment of a microwave resonator according to the invention.

Shown in FIG. 14 is a further embodiment of a microwave resonator 1 according to the invention. This embodiment is similar to that of FIG. 8 but employs different forms of input and output microwave couplers 18,20. The input microwave coupler 18 comprises an electrically conductive central resonator body 30 which extends from (and is in electrical contact with) the tube wall 3 into the tube bore 4. It extends in a direction substantially normal to the length axis. An electrically conducting finger 31 extends from (and is in electrical contact with) the tube wall 3 opposite the central resonator body 30 towards the central resonator body 30. The central resonator body 30 is hollow. Accordingly, the finger 31 can extend into the central resonator body 30 but still be spaced apart from it. The finger 31 and the central resonator body 30 are arranged in the gap between the first closing plate 8 and the input puck 10 as shown. The input microwave coupler 18 further comprises an electrically conductive iris plate 32 arranged normal to the length axis 5 in the space between the central resonator body 30 and the input puck 10. A single slot 33 extends through the iris plate 32.

The central resonator body 30, finger 31 and adjacent iris plate 32 together form a combline resonator. A microwave signal provided to the central resonator body 30 along a wire generates a magnetic field within the combline resonator. This passes through the slot 33 in the iris plate 32 and excites the input puck 10.

The structure of the output microwave coupler 20 is the same as that of the input microwave coupler 18. The magnetic field generated by the output puck 11 passes through the slot 33 in the iris plate 32 into the combline resonator from where it can be extracted by a wire connected to the central resonator body 30.

Figure 15:
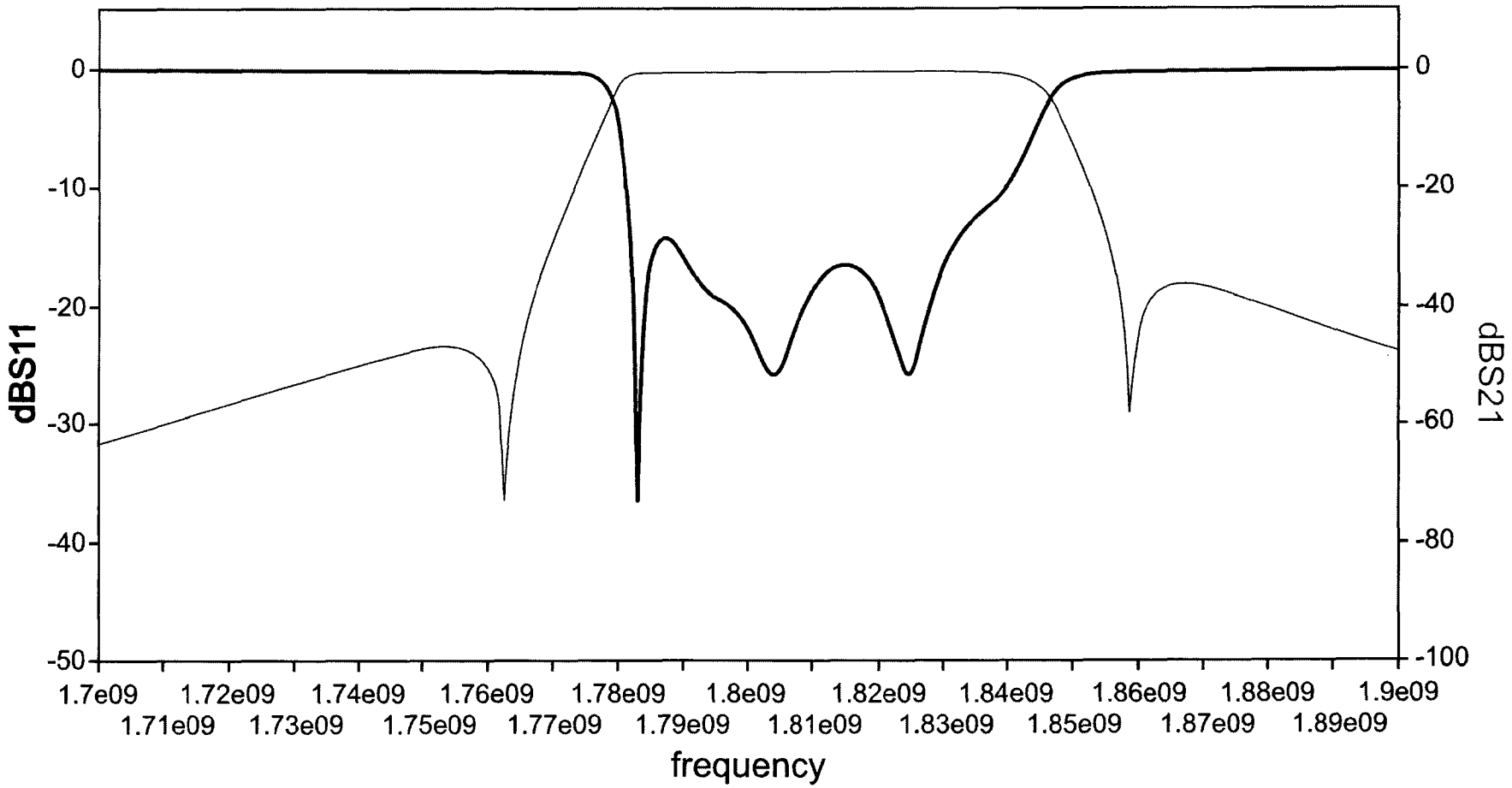
FIG. 15 shows the electrical response of the microwave resonator of FIG. 14.

The electrical response of such a microwave resonator 1 is shown in FIG. 15.

Figure 16:
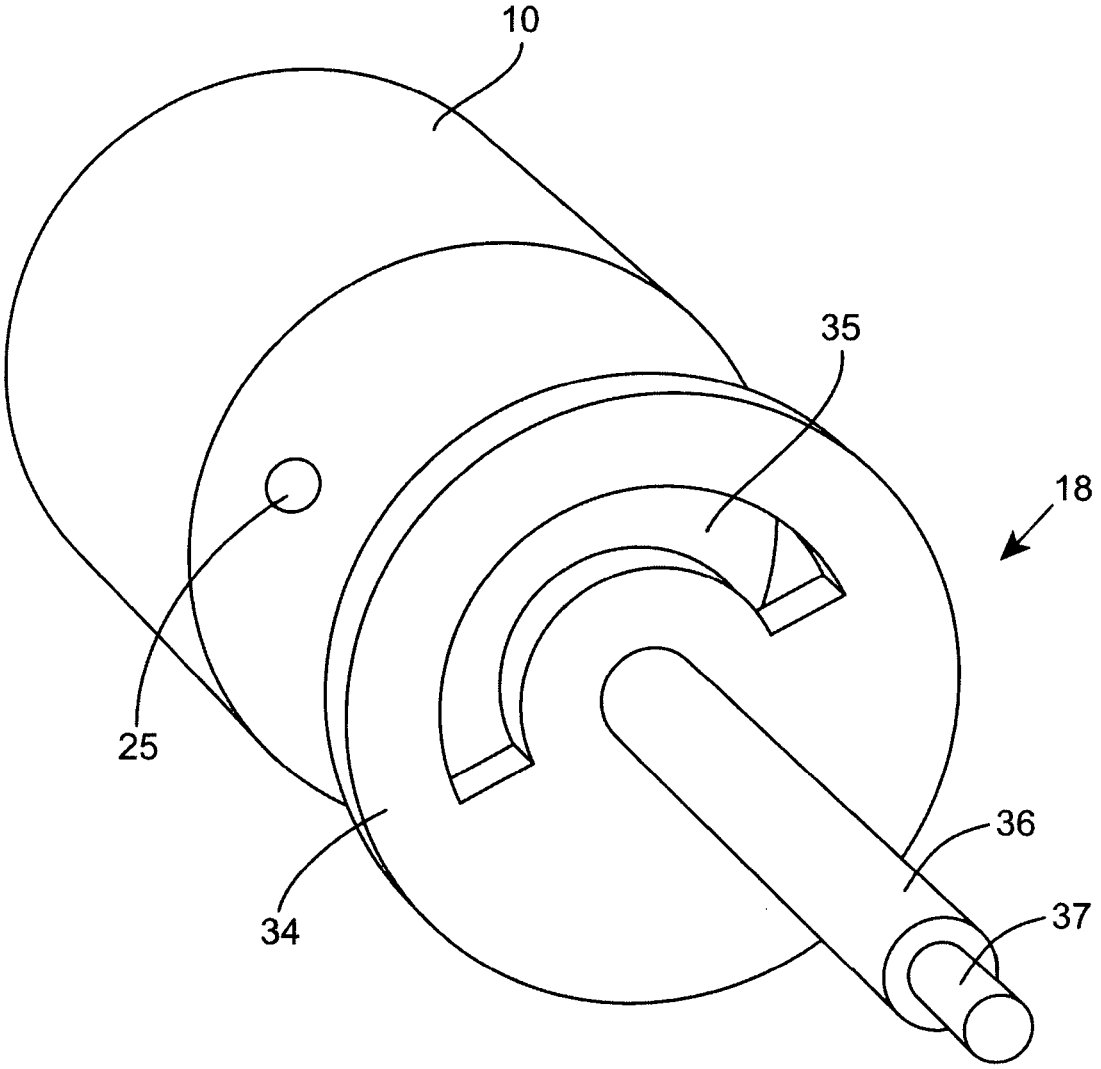
FIG. 16 shows a portion of a further embodiment of a microwave resonator according to the invention.

Shown in FIG. 16 is the input puck 10 and input microwave coupler 18 of a further embodiment of a microwave resonator 1 according to the invention. The remaining pucks and tube are not shown for clarity. Again, the puck 10 comprises a symmetry breaking structure 22 comprising an aperture 25 extending through the puck 10. The input microwave coupler 18 comprises an electrically conductive iris plate 34 arranged normal to the length axis 5 and spaced apart from the puck 10. An aperture 35 extends through the iris plate 34. Extending from (and in electrical contact with) the iris plate 34 towards the first closing plate (not shown) is a central resonator body 36. The central resonator body 36 is hollow. A finger 37 extends through (and is in electrical contact with) the first closing plate towards and into the central resonator body 36 as shown. Again, the finger 37, iris plate 34 and central resonator body 36 form a combline resonator. A microwave signal provided to the central resonator body 36 by a wire connected to the central resonator body 36 part way along its length produces a magnetic field in the combline resonator. This passes through the aperture 35 in the iris plate 34 and excites the puck 10. The output microwave coupler (not shown) is of the same structure as the input microwave coupler 18

Figure 17:
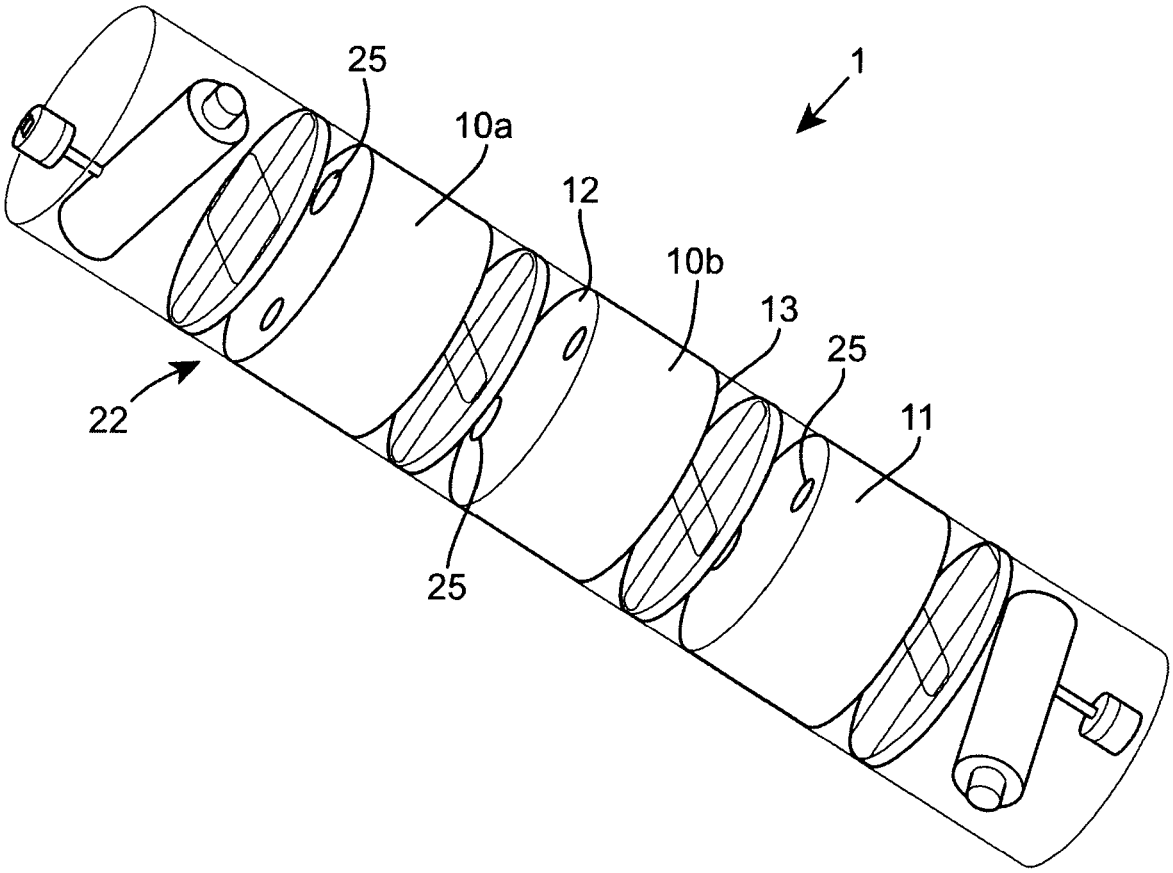
FIG. 17 shows a further embodiment of a microwave resonator according to the invention.

Shown in FIG. 17 is a further embodiment of a microwave resonator 1 according to the invention and which comprises three pucks 10*a*,10*b*,11. The three pucks 10*a*,10*b*,11 are of slightly different thicknesses to provide the desired behaviour of the resonator 1. The symmetry breaking structures 22 of each of the pucks 10*a*,10*b*,11 comprises a plurality of holes 25 extending from one end face 12 of the puck 10*a*,10*b*,11 to the other end face 13 parallel to and spaced apart from the length axis.

Figure 18:
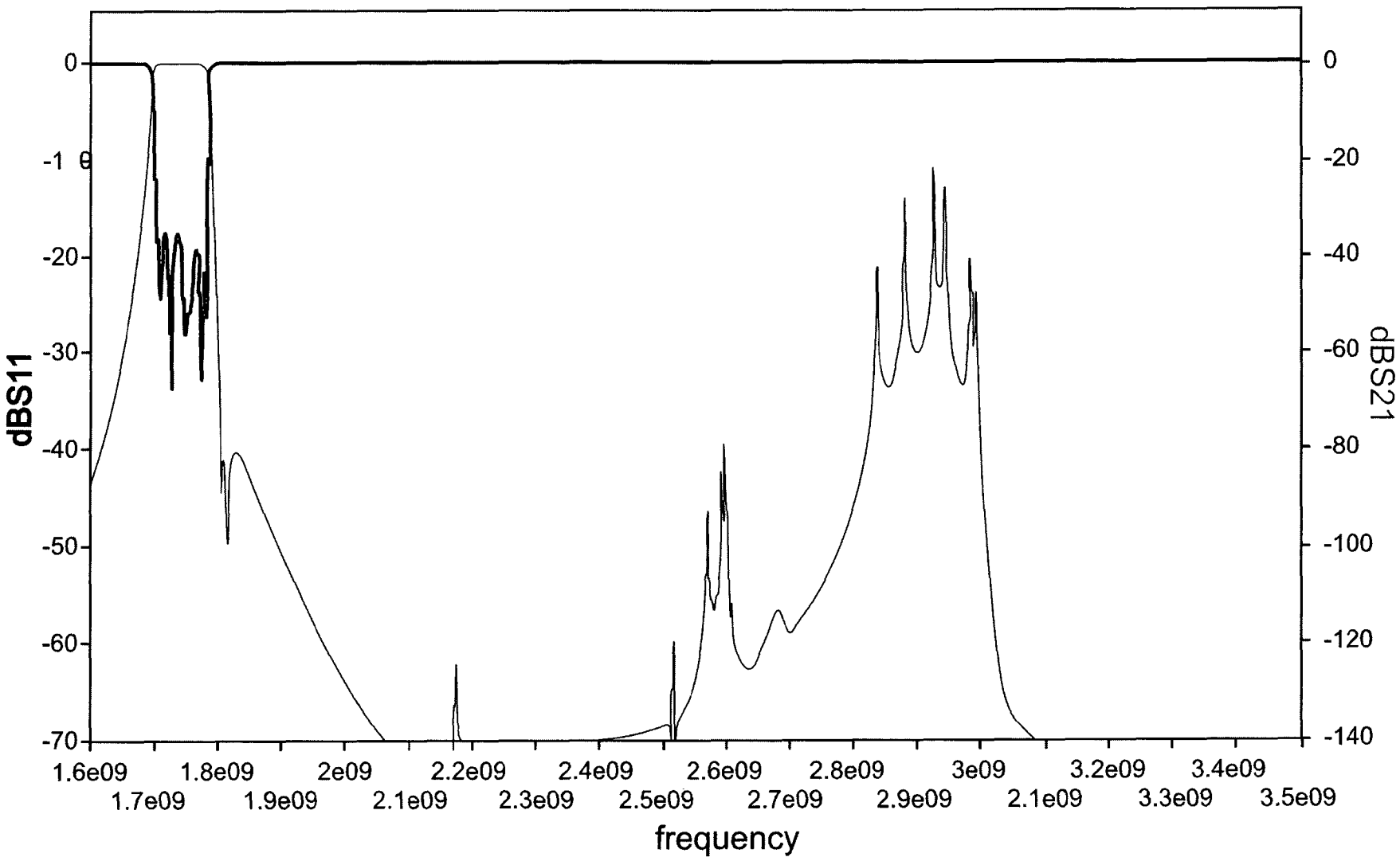
FIG. 18 shows the behaviour of the microwave resonator of FIG. 17.

The behaviour of the microwave resonator 1 of FIG. 17 is shown in FIG. 18. Whilst the doubly degenerate mode of the dielectric pucks 10*a*,10*b*,11 is the $H_{111}$ mode the resonator 1 as a whole resonates mainly in the $HE_{111}$ mode. The $HE_{111}$ mode is shown around 1.7 GHz. The spurious response around 2.9 GHz is the result of coupling into the $HE_{112}$ mode in the dual mode resonant pucks 10*a*,10*b*,11. The $HE_{112}$ mode has a field structure like the $HE_{111}$ mode. The difference is an additional variation along the length axis within the pucks 10*a*,10*b*,11. As the field structure is very similar it is excited by the same coupling methods as the $HE_{111}$ mode, i.e. any approach which couples strongly into the $HE_{111}$ mode will also couple strongly into the $HE_{112}$ mode. The reason it is not more pronounced is that the input and output combline resonators are resonant at the fundamental mode but have some rejection at 2.9 GHz.

It is desired to reduce this spurious response.

Figure 19:
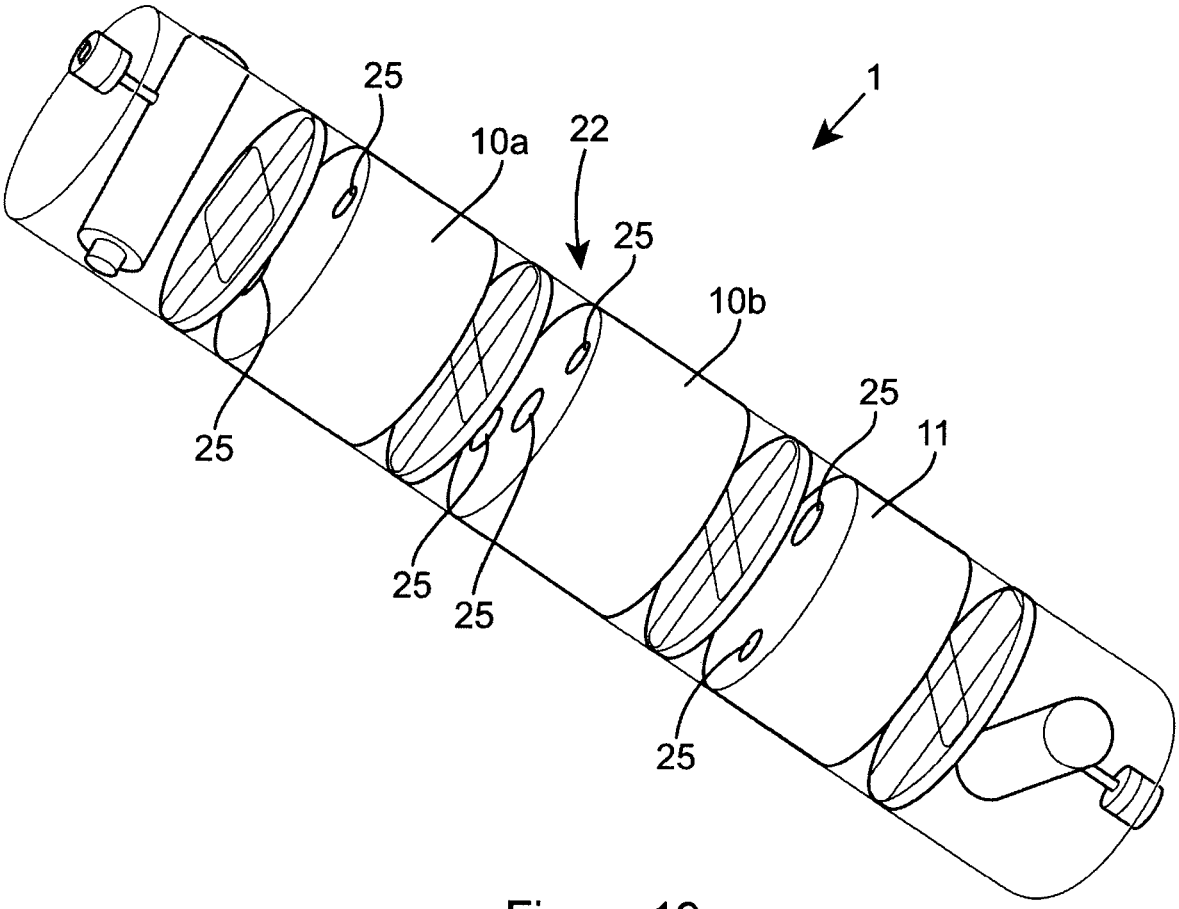
FIG. 19 shows a further embodiment of a microwave resonator according to the invention.

One approach is shown in FIG. 19. In this embodiment the symmetry breaking structure 22 of each of the first and third pucks 10*a*,11 comprises a pair of apertures 25. The distances of the apertures 25 from the length axis and also the diameters of the apertures 25 for the first puck 10*a* are different to those of the third puck 11. The central puck 10*b* comprises three apertures 25. In addition to two apertures 25 spaced apart from the length axis the central puck 10*b* further comprises a third aperture 25 extending along the length axis. When compared to the embodiment of FIG. 17 moving the apertures 25 away from the length axis and increasing their diameter and also adding a third aperture along the central axis changes (typically increases) the resonant frequencies of the pucks 10*a*,10*b*,11. In order to compensate for this the thicknesses of the pucks 10*a*,10*b*,11 are changed (typically increased) to return the $HE_{111}$ modes to their original frequency. This increase in thickness however brings down the $HE_{112}$ modes by a larger ratio relative to the change in the $HE_{111}$ modes. Accordingly, by following this approach one can separate the $HE_{112}$ modes from each other without separating the $HE_{111}$ modes.

Figure 20:
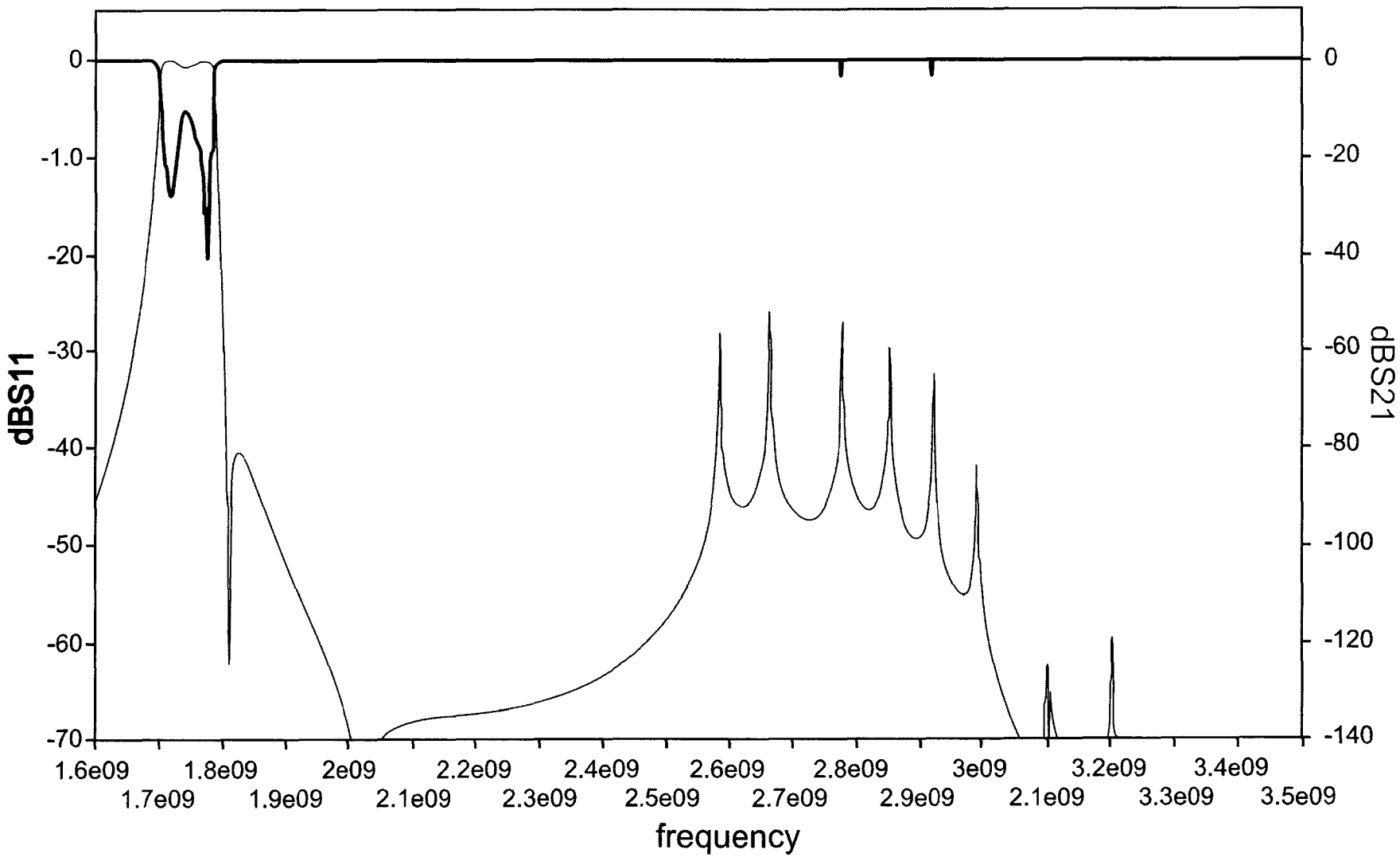
FIG. 20 shows the behaviour of the microwave resonator of FIG. 19.

FIG. 20 shows the behaviour of the microwave resonator of FIG. 19. As can be seen the $HE_{112}$ modes are separated and consequently the spurious response is reduced.

Figure 21:
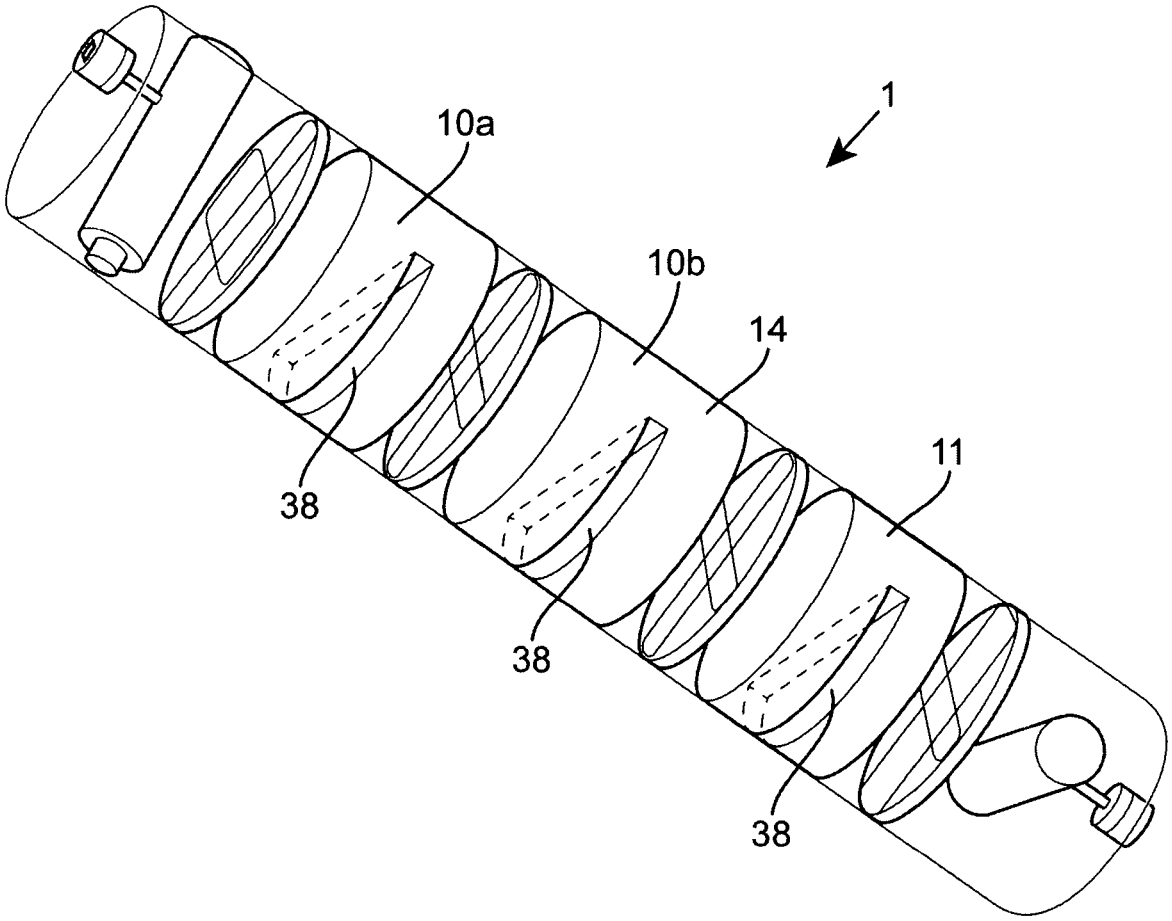
FIG. 21 shows a further embodiment of a microwave resonator according to the invention.

An alternative approach is to suppress the coupling between the orthogonal $HE_{112}$ modes within the resonator 1. Shown in FIG. 21 is an alternative embodiment of a microwave resonator 1 according to the invention. The symmetry breaking structure 22 of each of the pucks 10*a*,10*b*,11 comprises a slot 38. Each slot 38 is arranged in a plane normal to the length axis and mid way between the end faces 12,13 of its puck 10*a*,10*b*,11. Each slot 38 extends part way around the side wall 14 of its puck 10*a*,10*b*,11 as shown. Each slot 38 is of different dimensions.

The plane of each puck 10*a*,10*b*,11 mid-way between its end faces 12,13 is a low field region in the $HE_{112}$ mode. The effect of the slots 38 on the $HE_{112}$ modes of the resonator 1 is therefore reduced compared to the effect on the $HE_{111}$ modes. The modes will still couple strongly from the outside but the bandwidth of the dual mode spurious resonances will be reduced which simplifies the separation of the $HE_{112}$ modes from the multiple dual mode resonant pucks 10*a*, 10*b*,11.

Shown in FIG. 22 is the behaviour of the microwave resonator 1 of FIG. 21.

Shown in FIG. 23 is a further embodiment of a microwave resonator 1 according to the invention. This is similar to that of FIG. 21 except the slots 38 are replaced with apertures 39. The apertures 39 extend from the side walls 14 of the pucks 10*a*,10*b*,11 into the pucks 10*a*,10*b*,11 normal to the length axis. Each aperture 39 is arranged substantially mid-way between the end faces 12,13 of its puck 10*a*,10*b*,11. As with the embodiment of FIG. 21, the effect of the apertures 39 on the $HE_{112}$ mode is less than the effect on the $HE_{111}$ mode. Again the lengths of the pucks 10*a*,10*b*,11 are adjusted to compensate for the effect of the apertures 39 on the frequencies of the $HE_{111}$ modes All of the microwave resonators 1 as previously described may be employed in larger structures. They may be employed in filters comprising a plurality of such resonators 1. The resonators 1 may be connected together in parallel or cascade. They may also be employed in multiplexers (the term being used broadly to cover both multiplexers and demultiplexers). A multiplexer would typically employ a plurality of such resonators 1.

The invention claimed is:

1. A microwave resonator comprising:

a hollow tube comprising an electrically conductive tube wall which defines a tube bore, the tube extending along a length axis from a first end to a second end;

a first electrically conductive closing plate closing the first end of the tube;

a second electrically conductive closing plate closing the second end of the tube;

a plurality of dielectric resonant pucks, each of the pucks comprising first and second end faces and a side wall extending therebetween, each of the pucks being dimensioned such that its dominant mode is a doubly degenerate mode;

the pucks being arranged within the tube bore spaced apart from each other and from the first and second closing plates, each of the pucks being arranged with its end faces normal to the length axis and centered on the length axis and its side wall abutting the tube wall such that there is no air gap between the puck and tube wall which extends from one end face to the other of the puck, the puck adjacent to the first closing plate being termed an input puck;

each of the pucks being separated from the adjacent puck in the tube bore by a coupling gap, each of the coupling gaps having an electrically conductive iris plate arranged therein, each of the iris plates being arranged normal to the length axis, each of the iris plates comprising at least one coupling slot extending therethrough;

an input microwave coupler adapted to receive a microwave signal and provide it to the input puck; and each of the pucks comprising a symmetry breaking structure for modifying a frequency of one of a first degenerate mode and a second degenerate mode of the degenerate doubly degenerate mode relative to the other of the first and second degenerate modes and the coupling between the first and second degenerate modes.

2. A microwave resonator as claimed in claim 1 wherein the pucks are all of the same thickness from one end face to the other.

3. A microwave resonator as claimed in claim 1, wherein each of the pucks is dimensioned such that its dominant mode is a doubly degenerate $H_{111}$ mode.

4. A microwave resonator as claimed in claim 1, wherein the end faces of each puck are circular.

5. A microwave resonator as claimed in claim 1, wherein the pucks are equally spaced apart.

6. A microwave resonator as claimed in claim 1, wherein a separation between the first closing plate and the input puck is between 0.25 and 0.75 times the thickness of the input puck, more preferably between 0.4 and 0.6 times the thickness of the input puck.

7. A microwave resonator as claimed in claim 1, wherein the sidewall of each of the pucks is coated with an electrically conductive layer, the electrically conductive layer forming a portion of the tube wall.

8. A microwave resonator as claimed in claim 1, wherein a portion of each of the iris plates forms a portion of the tube wall.

9. A microwave resonator as claimed in claim 1, wherein each of the iris plates comprises a single coupling slot.

10. A microwave resonator as claimed in claim 1, wherein each of the iris plates comprises two coupling slots, one normal to the other.

11. A microwave resonator as claimed in claim 1, wherein:

the plurality of dielectric resonant pucks includes two pucks only, the two pucks having an iris plate arranged therebetween.

12. A microwave resonator as claimed in claim 1, wherein the face of the input puck adjacent to the first closing plate is termed the input face, and;

the input microwave coupler includes an electrically conductive coupling strip arranged on the input face.

13. A microwave resonator as claimed in claim 12 wherein the coupling strip is inclined to the at least one coupling slot.

14. A microwave resonator as claimed in claim 1 wherein the input microwave coupler comprises:

(i) an electrically conductive central resonator body extending from the tube wall into the tube bore substantially normal to the length axis;

(ii) an electrically conductive finger extending from the tube wall opposite the central resonator body towards the central resonator body, the central resonator body and finger being arranged in the gap between the input puck and first closing plate; and, (iii) an electrically conductive iris plate arranged in the tube bore normal to the length axis between the central resonator body and the input puck.

15. A microwave resonator as claimed in claim 1, wherein the input microwave coupler includes:

an electrically conductive iris plate arranged in the tube bore substantially normal to the length axis between the input puck and first closing plate, the iris plate having an aperture therein, and a central resonator body extending from the iris plate towards the first closing plate.

16. A microwave resonator as claimed claim 1, wherein:

the puck adjacent to the second closing plate is termed an output puck; and the microwave resonator includes an output microwave coupler adapted to receive a microwave signal from the output puck.

17. A microwave resonator as claimed in claim 16 wherein the face of the output puck adjacent to the second closing face is termed the output face, the output microwave coupler comprising an electrically conductive strip arranged on the output face.

18. A microwave resonator as claimed in claim 16 wherein the output microwave coupler comprises:

(i) an electrically conductive central resonator body extending from the tube wall into the tube bore substantially normal to the length axis;

(ii) an electrically conductive finger extending from the tube wall opposite the central resonator body towards the central resonator body, the central resonator body and finger being arranged in the gap between the output puck and second closing plate; and, (iii) an electrically conductive iris plate arranged in the tube bore normal to the length axis between the central resonator body and output puck.

19. A microwave resonator as claimed in claim 16, wherein the output microwave coupler includes:

an electrically conductive iris plate arranged in the tube bore substantially normal to the length axis between the output puck and the second closing plate, the iris plate having an aperture therein, and a central resonator body extending from the iris plate towards the second closing plate.

20. A microwave resonator as claimed in claim 1 wherein the symmetry breaking structure of at least one puck of the plurality of dielectric resonant pucks comprises a first electrically conductive adjustment strip arranged on a face of the at least one puck, the adjustment strip extending along a first adjustment strip axis passing through the center of the at least one puck.

21. A microwave resonator as claimed in claim 20 wherein the symmetry breaking structure further comprises a second electrically conductive adjustment strip arranged on the same face of the at least one puck as the first electrically conductive adjustment strip, the second electrically conductive adjustment strip extending along a second adjustment strip axis passing through the center of the at least one puck.

22. A microwave resonator as claimed in claim 21 wherein the first and second adjustment strip axes meet at an angle of 25 and 65 degrees.

23. A microwave resonator as claimed in claim 20, wherein the first electrically conductive adjustment strip extends from the tube wall towards the center of the face of the at least one puck.

24. A microwave resonator as claimed in claim 20, wherein the first electrically conductive adjustment strip extends from a point proximate to but spaced apart from the tube wall towards the center of the face of the at least one puck.

25. A microwave resonator as claimed in claim 1, wherein the symmetry breaking structure of at least one puck of the plurality of dielectric resonant pucks comprises at least one aperture extending through the at least one puck from one of the first and second end faces of the at least one puck to the other of the first and second end faces of the at least one puck;

wherein the at least one aperture is parallel to and spaced apart from the length axis.

26. A microwave resonator as claimed in claim 25, wherein the symmetry breaking structure of an at least second puck of the plurality of dielectric resonant pucks comprises at least one aperture extending through the at least second puck from one of the first and second end faces of the at least second puck to the other of the first and second end faces of the at least second puck;

wherein the at least one aperture is parallel to and spaced apart from the length axis.

27. A microwave resonator as claimed in claim 26 wherein the at least one aperture is one of a different diameter and a different distance from the length axis than the aperture of the at least second puck.

28. A microwave resonator as claimed in claim 25, wherein the symmetry breaking structure of the at least one puck includes a second aperture extending along the length axis from one face to the other.

29. A microwave resonator as claimed in claim 1 wherein the symmetry breaking structure of at least one puck of the plurality of dielectric resonant pucks comprises at least one slot in the at least one puck arranged in a plane normal to the length axis and part way between the first and second end faces of the at least one puck.

30. A microwave resonator as claimed in claim 29 wherein the slot is arranged mid-way between the first and second end faces of the at least one puck.

31. A microwave resonator as claimed in claim 29, wherein the at least one puck comprises a plurality of pucks, and wherein a dimension of the at least one slot of the at least one puck is different from a corresponding dimension of the at least one slot of another puck of the plurality of pucks.

32. A microwave resonator as claimed in claim 1, wherein the symmetry breaking structure of at least one puck of the plurality of dielectric resonant pucks comprises at least one aperture extending from the side wall of the at least one puck into the at least one puck normal to the length axis.

33. A microwave resonator as claimed in claim 32 wherein the at least one aperture is arranged mid way between the end faces of the at least one puck.

34. A microwave resonator as claimed in claim 32, wherein the at least one puck comprises a plurality of pucks, and wherein a diameter of the aperture of the at least one puck is different from a corresponding diameter of another puck of the plurality of pucks.

35. A microwave filter comprising:

a plurality of microwave resonators connected together in one of parallel and cascade;

wherein at least one of the microwave resonators comprises:

a hollow tube comprising an electrically conductive tube wall which defines a tube bore, the tube extending along a length axis from a first end to a second end;

a first electrically conductive closing plate closing the first end of the tube;

a second electrically conductive closing plate closing the second end of the tube;

a plurality of dielectric resonant pucks, each of the pucks comprising first and second end faces and a side wall extending therebetween, each of the pucks being dimensioned such that its dominant mode is a doubly degenerate mode;

the pucks being arranged within the tube bore spaced apart from each other and from the first and second closing plates, each of the pucks being arranged with its end faces normal to the length axis and centered on the length axis and its side wall abutting the tube wall such that there is no air gap between the puck and tube wall which extends from one end face to the other of the puck, the puck adjacent to the first closing plate being termed an input puck;

each of the pucks being separated from the adjacent puck in the tube bore by a coupling gap, each coupling gap having an electrically conductive iris plate arranged therein, each iris plate being arranged normal to the length axis, each iris plate comprising at least one coupling slot extending therethrough;

an input microwave coupler adapted to receive a microwave signal and provide it to the input puck; and each of the pucks comprising a symmetry breaking structure for modifying a frequency of one of a first degenerate mode and a second degenerate mode of the degenerate doubly degenerate mode relative to the other of the first and second degenerate modes and the coupling between the first and second degenerate modes.

36. A microwave multiplexer comprising:

a plurality of microwave resonators;

wherein at least one of the microwave resonators comprises:

a hollow tube comprising an electrically conductive tube wall which defines a tube bore, the tube extending along a length axis from a first end to a second end;

a first electrically conductive closing plate closing the first end of the tube;

a second electrically conductive closing plate closing the second end of the tube;

a plurality of dielectric resonant pucks, each of the pucks comprising first and second end faces and a side wall extending therebetween, each of the pucks being dimensioned such that its dominant mode is a doubly degenerate mode;

the pucks being arranged within the tube bore spaced apart from each other and from the first and second closing plates, each of the pucks being arranged with its end faces normal to the length axis and centered on the length axis and its side wall abutting the tube wall such that there is no air gap between the puck and tube wall which extends from one end face to the other of the puck, the puck adjacent to the first closing plate being termed an input puck;

each of the pucks being separated from the adjacent puck in the tube bore by a coupling gap, each of the coupling gaps having an electrically conductive iris plate arranged therein, each of the iris plates being arranged normal to the length axis, each of the iris plates comprising at least one coupling slot extending therethrough;

an input microwave coupler adapted to receive a microwave signal and provide it to the input puck; and each of the pucks comprising a symmetry breaking structure for modifying a frequency of one of a first degenerate mode and a second degenerate mode of the degenerate doubly degenerate mode relative to the other of the first and second degenerate modes and the coupling between the first and second degenerate modes.

* * * * *